US012018871B2

(12) United States Patent
Yu

(10) Patent No.: US 12,018,871 B2
(45) Date of Patent: Jun. 25, 2024

(54) ENERGY EFFICIENT HEAT PUMP WITH VALVE SYSTEM AND COUNTERFLOW ARRANGEMENT

(71) Applicant: Johnson Controls Tyco IP Holdings LLP, Milwaukee, WI (US)

(72) Inventor: Rong Yu, Moore, OK (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 0 days.

(21) Appl. No.: 18/306,819

(22) Filed: Apr. 25, 2023

(65) Prior Publication Data

US 2023/0341158 A1 Oct. 26, 2023

Related U.S. Application Data

(60) Provisional application No. 63/334,530, filed on Apr. 25, 2022.

(51) Int. Cl.
*F25B 41/26* (2021.01)
*F25B 13/00* (2006.01)

(52) U.S. Cl.
CPC ..... *F25B 41/26* (2021.01); *F25B 13/00* (2013.01); *F25B 2313/02743* (2013.01); *F25B 2313/0276* (2013.01)

(58) Field of Classification Search
CPC ..... F25B 41/26; F25B 13/00; F25B 2313/02743; F25B 2313/0276
See application file for complete search history.

(56) References Cited

U.S. PATENT DOCUMENTS

| | | | | |
|---|---|---|---|---|
| 4,441,335 | A * | 4/1984 | Bonne | F25B 13/00 137/563 |
| 2015/0285539 | A1* | 10/2015 | Kopko | F25B 41/39 62/324.1 |
| 2019/0061470 | A1* | 2/2019 | Koberstein | B60H 1/00392 |
| 2022/0010981 | A1* | 1/2022 | Narayanan | F28F 3/048 |

* cited by examiner

*Primary Examiner* — Henry T Crenshaw
(74) *Attorney, Agent, or Firm* — Fletcher Yoder, P.C.

(57) ABSTRACT

An energy efficient heat pump for a heating, ventilation, and air conditioning (HVAC) system includes a vapor compression circuit, a heat exchanger of the vapor compression circuit configured to place a working fluid in a heat exchange relationship with an air flow directed across the heat exchanger, and a valve system of the vapor compression circuit. The valve system is adjustable between a first configuration and a second configuration, the heat pump is configured to operate in a cooling mode with the valve system in the first configuration and in a heating mode with the valve system in the second configuration, and the valve system is configured to direct the working fluid into the heat exchanger to place the working fluid in a counterflow heat transfer arrangement with the air flow in the first configuration and in the second configuration.

20 Claims, 9 Drawing Sheets

ENERGY EFFICIENT HEAT PUMP WITH VALVE SYSTEM AND COUNTERFLOW ARRANGEMENT

CROSS REFERENCE TO RELATED APPLICATIONS

This application claims priority from and the benefit of U.S. Provisional Patent Application No. 63/334,530, entitled "VALVE ARRANGEMENT FOR AN HVAC SYSTEM," filed Apr. 25, 2022, which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Embodiments of the present disclosure are directed to heating, ventilation, and/or air conditioning (HVAC) systems with improved heat exchange efficiency. More particularly, embodiments of the present disclosure are directed to reducing energy consumption by employing a counterflow heat transfer arrangement, which limits corresponding emissions.

HVAC systems are utilized in residential, commercial, and industrial environments to control environmental properties, such as temperature and humidity, for occupants of the respective environments. An HVAC system may control environmental properties by controlling a supply air flow delivered to the environment. For example, the HVAC system may place the supply air flow in a heat exchange relationship with a working fluid of a vapor compression circuit to condition the supply air flow. In some instances, an HVAC system may be configured as a heat pump. The heat pump may operate in a heating mode and in a cooling mode. That is, the heat pump may operate in the heating mode to heat the supply air flow, and the heat pump may operate in the cooling mode to cool the supply air flow. The heat pump may direct a working fluid through a vapor compression circuit in different directions to enable operation in the cooling mode and in the heating mode. Unfortunately, existing heat pumps may operate inefficiently in the heating mode, the cooling mode, or both. It is now recognized that such inefficiencies can result in unnecessary energy consumption and associated emissions.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, an energy efficient heat pump for a heating, ventilation, and air conditioning (HVAC) system includes a vapor compression circuit, a first heat exchanger of the vapor compression circuit configured to place a working fluid in a first heat exchange relationship with a first air flow directed across the first heat exchanger, a second heat exchanger of the vapor compression circuit configured to place the working fluid in a second heat exchange relationship with a second air flow directed across the second heat exchanger, and a valve system of the vapor compression circuit. The valve system is adjustable between a first configuration and a second configuration, the heat pump is configured to operate in a cooling mode with the valve system in the first configuration, the heat pump is configured to operate in a heating mode with the valve system in the second configuration, and the valve system is configured to direct the working fluid into the first heat exchanger to place the working fluid in a counterflow heat transfer arrangement with the first air flow directed across the first heat exchanger in the first configuration and in the second configuration.

In another embodiment, an energy efficient heat pump for a heating, ventilation, and air conditioning (HVAC) system includes a vapor compression circuit configured to circulate a working fluid therethrough, and a first heat exchanger disposed along the vapor compression circuit, where the first heat exchanger configured to place the working fluid in a first heat exchange relationship with a first air flow directed across the first heat exchanger, and a second heat exchanger disposed along the vapor compression circuit, where the second heat exchanger configured to place the working fluid in a second heat exchange relationship with a second air flow directed across the second heat exchanger. The heat pump also includes a valve system disposed along the vapor compression circuit, where the valve system is configured to direct the working fluid to a first inlet port of the first heat exchanger and to receive the working fluid from a first outlet port of the first heat exchanger in a cooling mode of the heat pump and in a heating mode of the heat pump, and the valve system is configured to direct the working fluid to a second inlet port of the second heat exchanger and to receive the working fluid from a second outlet port of the second heat exchanger in the cooling mode and in the heating mode.

In a further embodiment, an energy efficient heat pump for a heating, ventilation, and air conditioning (HVAC) system includes a compressor and a first heat exchanger having a first inlet port and a first outlet port, where the first heat exchanger is configured to direct a working fluid from the first inlet port to the first outlet port to place the working fluid in a first counterflow arrangement with a first air flow directed across the first heat exchanger. The heat pump also includes a second heat exchanger having a second inlet port and a second outlet port, where the second heat exchanger is configured to direct the working fluid from the second inlet port to the second outlet port to place the working fluid in a second counterflow arrangement with a second air flow directed across the second heat exchanger. The heat pump further includes a valve system configured to control flow of the working fluid through the heat pump, where the valve system is configured to direct the working fluid to the first inlet port and to the second inlet port in a cooling mode of the heat pump and in a heating mode of the heat pump, and the valve system is configured to receive the working fluid from the first outlet port and from the second outlet port in the cooling mode and in the heating mode.

DETAILED DESCRIPTION

Figure 1:
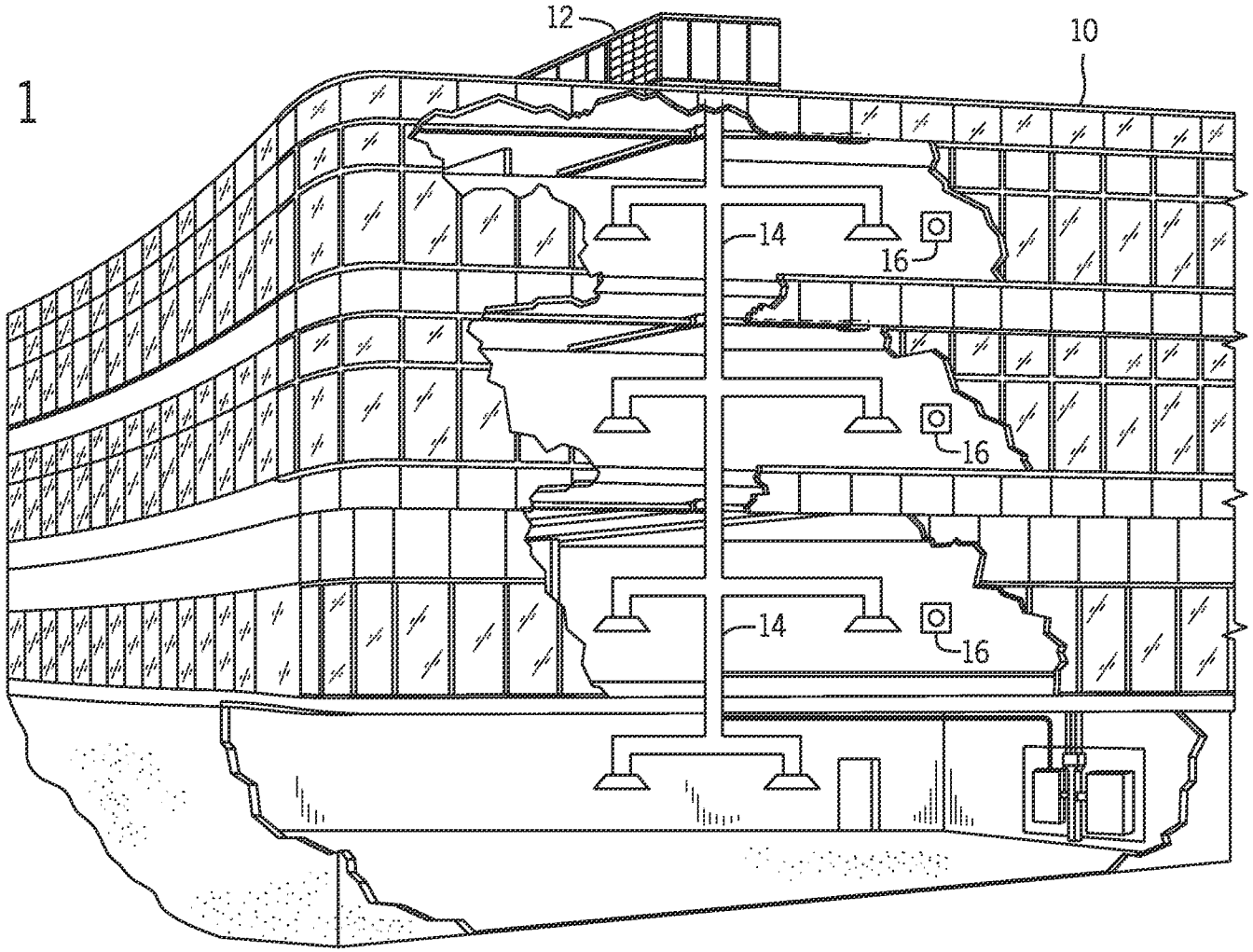
FIG. 1 is a perspective view of an embodiment of a heating, ventilation, and air conditioning (HVAC) system for environmental management including an HVAC unit, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

As used herein, the terms "approximately," "generally," and "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to mean that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to mean that the given feature is within +/−5%, within +/−4%, within +/−3%, within +/−2%, within +/−1%, or even closer, to having the described nature, such as being parallel to another feature, being perpendicular to another feature, and so forth. Further, it should be understood that mathematical terms, such as "planar," "slope," "perpendicular," "parallel," and so forth are intended to encompass features of surfaces or elements as understood to one of ordinary skill in the relevant art, and should not be rigidly interpreted as might be understood in the mathematical arts. For example, a "planar" surface is intended to encompass a surface that is machined, molded, or otherwise formed to be substantially flat or smooth (within related tolerances) using techniques and tools available to one of ordinary skill in the art. Similarly, a surface having a "slope" is intended to encompass a surface that is machined, molded, or otherwise formed to be oriented at an angle (e.g., incline) with respect to a point of reference using techniques and tools available to one of ordinary skill in the art.

As briefly discussed above, a heating, ventilation, and air conditioning (HVAC) system may be used to regulate environmental parameters (e.g., temperature, humidity) within a space to be conditioned, such as a building, home, storage space, or other suitable structure. For example, the HVAC system may include a vapor compression circuit configured to transfer thermal energy between a working fluid, such as a refrigerant, and a fluid to be conditioned, such as air. The vapor compression circuit includes heat exchangers, such as a condenser and an evaporator, which are fluidly coupled to one another via one or more conduits of a working fluid circuit or working fluid loop. The vapor compression circuit may also include a compressor configured to circulate the working fluid through the conduits and other components of the vapor compression circuit (e.g., one or more expansion devices, the heat exchangers) and, thus, enable the transfer of thermal energy between components of the vapor compression circuit (e.g., between the condenser and the evaporator) and one or more thermal loads (e.g., an environmental air flow, a supply air flow).

Additionally or alternatively, the HVAC system may include a heat pump (e.g., a heat pump system, a reversible heat pump) having a first heat exchanger (e.g., a heating and/or cooling coil, an indoor coil, an evaporator) that may be positioned within the thermal load (e.g., space to be conditioned), a second heat exchanger (e.g., a heating and/or cooling coil, an outdoor coil, a condenser) that may be positioned in or otherwise fluidly coupled to an ambient environment (e.g., the atmosphere), and a pump (e.g., a compressor) configured to circulate the working fluid (e.g., refrigerant) between the first and second heat exchangers to enable heat transfer between the thermal load and the ambient environment, for example. The heat pump may be operable in different modes to selectively provide cooling and heating to the space to be conditioned (e.g., a room, zone, or other region within a building) by adjusting a flow (e.g., a direction of flow, a flow path) of the working fluid through the vapor compression circuit. For example, the heat pump may be a central HVAC system configured to generate and discharge a conditioned air flow to be distributed to a conditioned space or a plurality of conditioned spaces (e.g., rooms, zones) via an air distribution system, such as ductwork.

As will be appreciated, the heat pump may be configured to circulate the working fluid in different directions and/or along different flow paths to enable operation of the heat pump in different modes. For example, in a heating mode (e.g., to heat a supply air flow provided to a conditioned space), the heat pump may circulate the working fluid through the vapor compression circuit (e.g., at least a portion of the vapor compression circuit) in a first direction and/or along a first flow path, and in a cooling mode (e.g., to cool a supply air flow provided to a conditioned space), the heat pump may circulate the working fluid through the vapor compression circuit (e.g., at least a portion of the vapor compression circuit) in a second direction and/or along a second flow path that is opposite the first direction and/or different from the first flow path. Thus, the heat pump may not include a dedicated heating system, such as a furnace or burner configured to combust a fuel, to enable operation of the HVAC system in the heating mode. As a result, the heat pump operates with reduced greenhouse gas emissions.

Performance (e.g., efficiency) of a heat pump may be affected by an arrangement or configuration of components of the heat pump. As mentioned above, a heat exchanger of the heat pump may be configured to enable heat transfer between a working fluid circulated through the heat exchanger and an air flow directed across the heat exchanger. In general, the heat exchanger may operate more efficiently when the heat exchanger is configured to direct the working fluid through the heat exchanger and the air flow across the heat exchanger in opposite flow directions. Such an arrangement or configuration may be referred to as a counterflow arrangement (e.g., counterflow heat transfer arrangement). Conversely, the heat exchanger may operate less efficiently in a parallel flow arrangement in which the working fluid is directed through the heat exchanger and the air flow is directed across the heat exchanger in a common direction.

In traditional HVAC systems, the heat exchanger may be arranged such that the air flow travels across the heat exchanger in a predefined (e.g., predetermined) or generally fixed direction. Indeed, in traditional heat pumps, the air flow may be directed across the heat exchanger in the predefined direction in both a heating mode and a cooling mode of the heat pump. Thus, heat exchangers of traditional heat pumps place a working fluid and an air flow in a counterflow arrangement in one operating mode (e.g., cooling mode) and in a parallel flow arrangement in another operating mode (e.g., heating mode). Unfortunately, as discussed above, efficiency of heat exchangers operating in a parallel flow arrangement is limited. For example, traditional heat pumps that operate in a cooling mode with a counterflow arrangement and in a heating mode in a parallel flow arrangement may have limited efficiency (e.g., energy efficiency, heat transfer efficiency) in the heating mode.

Accordingly, it is now recognized that improved HVAC systems, including heat pumps, are desired. The present disclosure is directed to an improved valve system for a heat pump that is configured to place air flows and a working fluid in a counterflow arrangement in both a cooling mode and a heating mode of the heat pump. For example, the heat pump may include a vapor compression circuit with a valve system (e.g., a valve, a plurality of valves, a valve arrangement) configured to direct a working fluid through the heat exchanger in a flow direction that is opposite a flow direction of an air flow (e.g., a supply air flow, an ambient air flow) directed across the heat exchanger in both the cooling mode and the heating mode. As discussed in further detail below, the valve system may include a single valve disposed along the vapor compression circuit that is configured to direct the working fluid through a heat exchanger (e.g., an indoor heat exchanger) in a counterflow arrangement with an air flow (e.g., a supply air flow) in both the cooling mode and the heating mode, in some embodiments. In other embodiments, the valve system may include multiple valves (e.g., two valves, three valves, reversing valves) disposed along the vapor compression circuit that are configured to direct the working fluid through a heat exchanger in a counterflow arrangement with an air flow in both the cooling mode and the heating mode. In some embodiments, the valve system may be configured to direct the working fluid through multiple heat exchangers of the vapor compression circuit in respective counterflow arrangements with a respective air flow directed across each heat exchanger in both the cooling mode and the heating mode. Indeed, while the heat pump may generally direct the working fluid through at least a portion of the vapor compression circuit in opposite directions in the cooling mode and heating mode, the valve system may nevertheless enable flow of the working fluid through one or more heat exchangers in the same direction (e.g., in a counterflow arrangement with an air flow) in both modes. In this way, the heat pump may operate more efficiently (e.g., with improved heat transfer, with reduced energy consumption) in the cooling mode and in the heating mode.

The present techniques may be incorporated with different types or configurations of heat pumps. For example, the heat pump may be a single packaged unit having the first heat exchanger and the second heat exchanger. In other embodiments, the heat pump may be a split system having the first heat exchanger and the second heat exchanger in separate units (e.g., an indoor unit and an outdoor unit). In any case, the techniques disclosed herein (e.g., the valve system) may be implemented to enable a counterflow arrangement between a working fluid and an air flow in a heating mode and in a cooling mode of the heat pump for the first heat exchanger, the second heat exchanger, or both. By enabling and providing a counterflow heat transfer arrangement between the working fluid and an air flow (e.g., a supply air flow provided to conditioned space) in both the heating mode and the cooling mode, heat pumps incorporating the disclosed techniques may operate with improved heat transfer efficiency, reduced energy consumption, and greater overall HVAC system efficiency. Indeed, heat pumps incorporating the present techniques are configured to heat an air flow in an energy efficient manner and without operation of a furnace or other heating system configured to combust or consume a fuel and thereby provide a reduction of greenhouse gas emissions.

Turning now to the drawings, FIG. 1 illustrates an embodiment of a heating, ventilation, and air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor unit 58 and an indoor unit 56.

The HVAC unit 12 is an air-cooled device that implements a vapor compression cycle to provide conditioned air to the building 10. Specifically, the HVAC unit 12 may include one or more heat exchangers across which an air flow is passed to condition the air flow before the air flow is supplied to the building 10. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building 10 with one vapor compression circuit configured to operate in different modes. In other embodiments, the HVAC unit 12 may include one or more vapor compression circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building 10 control or monitoring systems, and even systems that are remote from the building 10.

Figure 2:
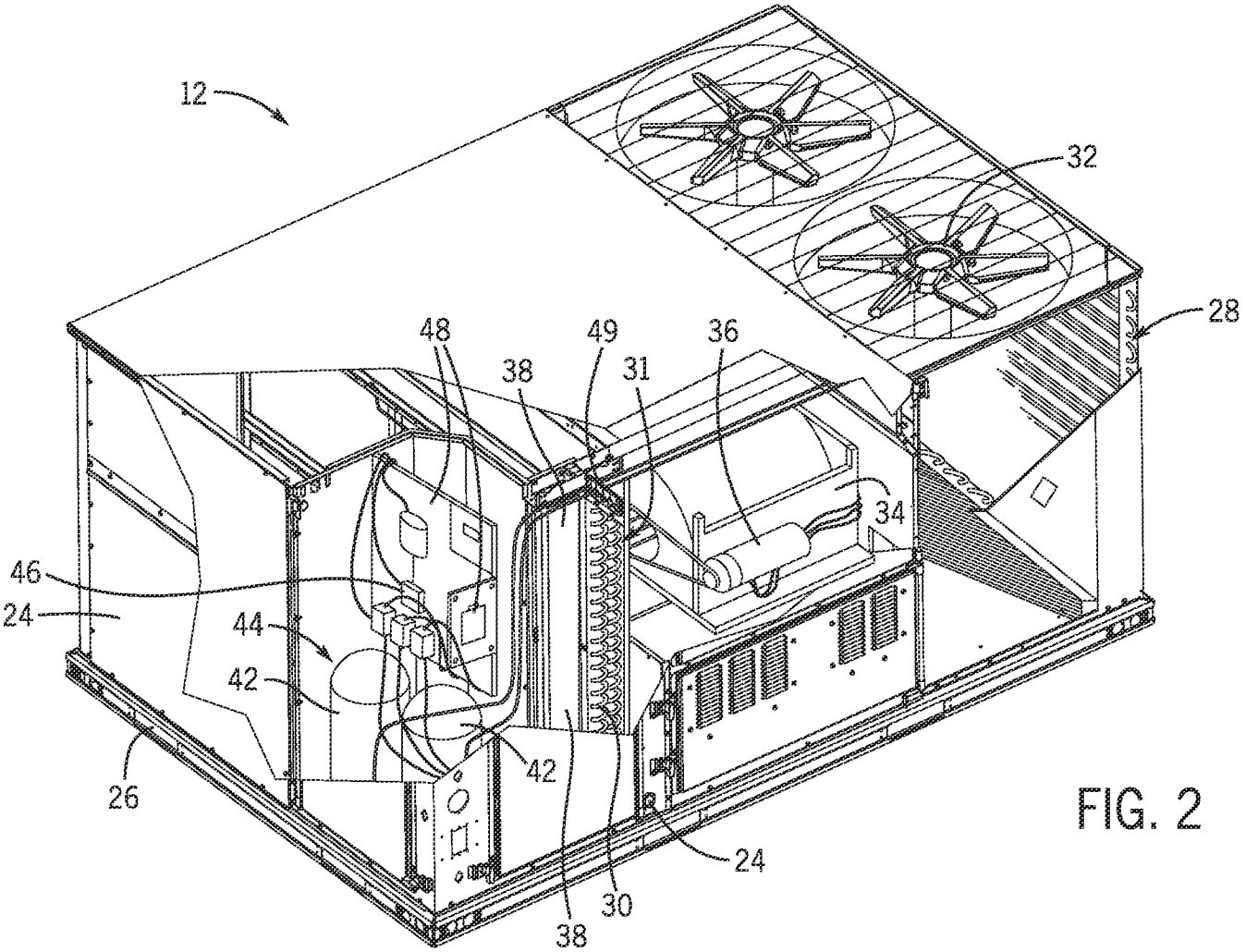
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent vapor compression circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more vapor compression circuits. Tubes within the heat exchangers 28 and 30 may circulate a working fluid (e.g., a refrigerant), such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the working fluid undergoes phase changes and/or temperature changes as it flows through the heat exchangers 28 and 30 to produce heated and/or cooled air. For example, the heat exchanger 28 may function as a condenser where heat is released from the working fluid to ambient air, and the heat exchanger 30 may function as an evaporator where the working fluid absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the working fluid before the working fluid enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
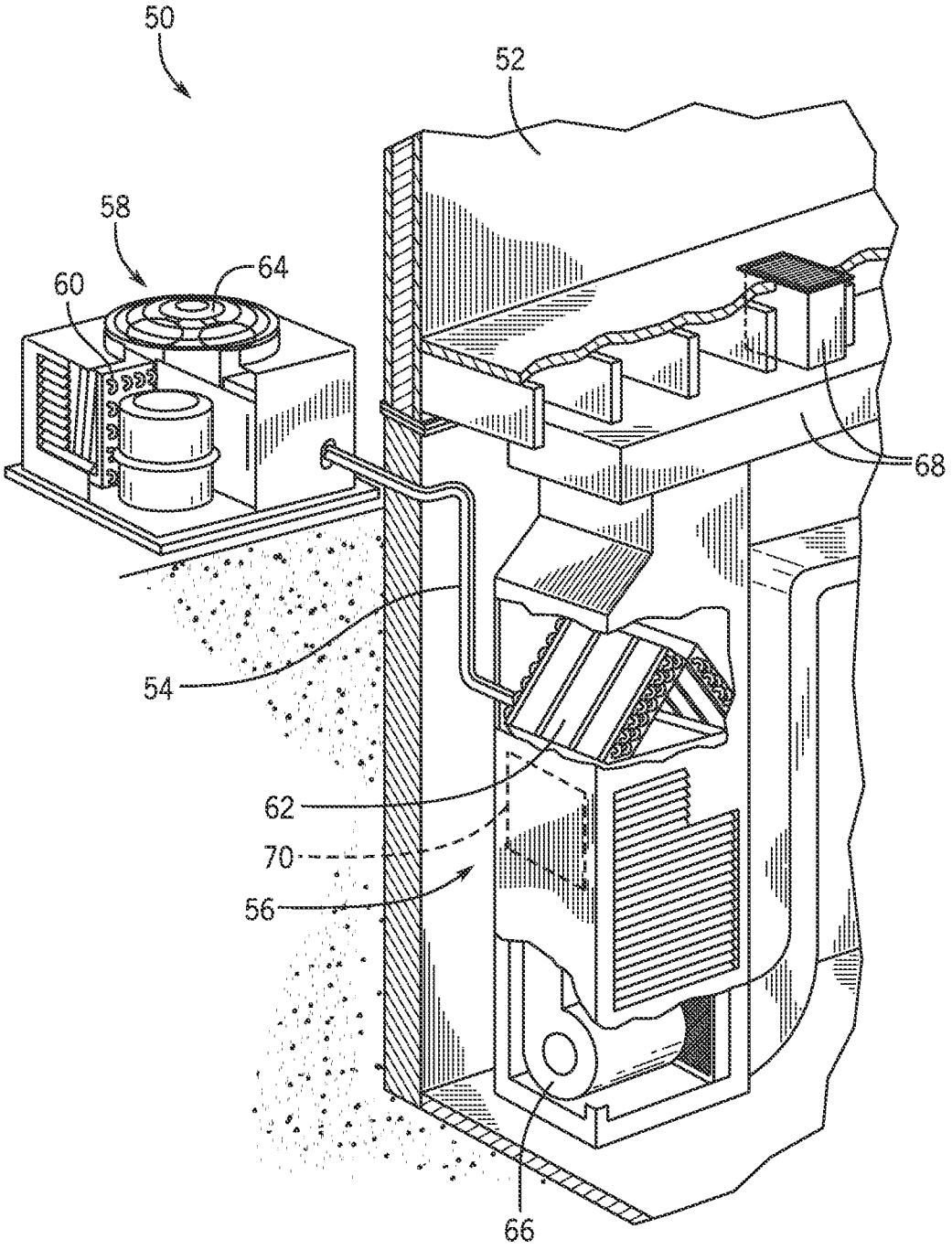
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include working fluid conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The working fluid conduits 54 transfer working fluid between the indoor unit 56 and the outdoor unit 58, typically transferring primarily liquid working fluid in one direction and primarily vaporized working fluid in an opposite direction.

When the system shown in FIG. 3 is operating as an air conditioner, a heat exchanger 60 in the outdoor unit 58 serves as a condenser for re-condensing vaporized working fluid flowing from the indoor unit 56 to the outdoor unit 58 via one of the working fluid conduits 54. In these applications, a heat exchanger 62 of the indoor unit functions as an evaporator. Specifically, the heat exchanger 62 receives liquid working fluid, which may be expanded by an expansion device, and evaporates the working fluid before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the vapor compression cycle temporarily. The outdoor unit 58 includes a reheat system in accordance with present embodiments.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate working fluid and thereby cool air entering the outdoor unit 58 as the air passes over the outdoor heat exchanger 60. The indoor heat exchanger 62 will receive a stream of air blown over it and will heat the air by condensing the working fluid.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
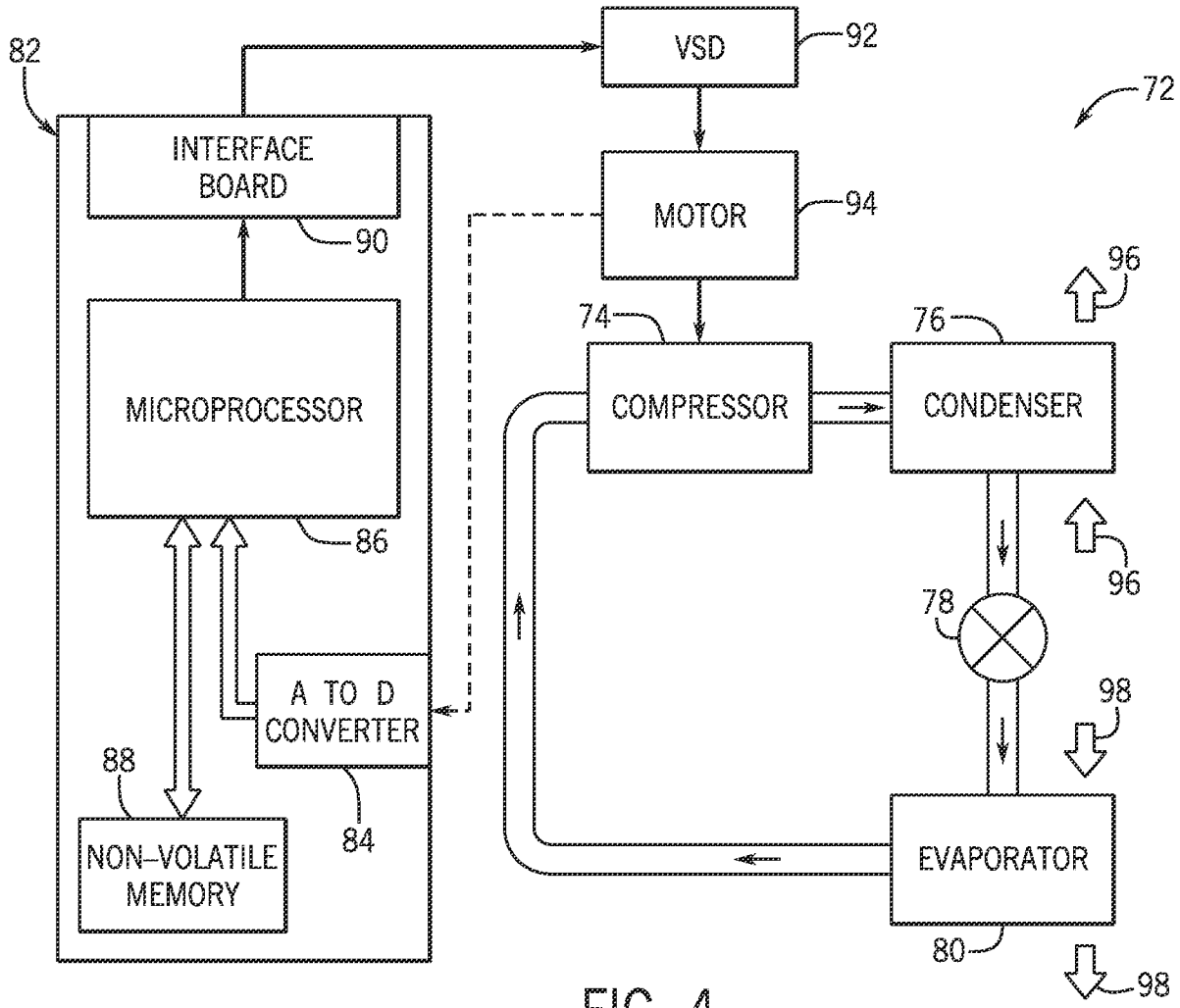
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 (e.g., vapor compression circuit) that can be used in any of the systems described above. The vapor compression system 72 may circulate a working fluid through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD 92 or directly from an AC or DC power source, such as a switched reluctance motor, an induction motor, an electronically commutated permanent magnet motor, or another suitable motor.

The compressor 74 compresses a working fluid vapor and delivers the vapor to the condenser 76 through a discharge passage. In some embodiments, the compressor 74 may be a centrifugal compressor. The working fluid vapor delivered by the compressor 74 to the condenser 76 may transfer heat to a fluid passing across the condenser 76, such as ambient or environmental air 96. The working fluid vapor may condense to a working fluid liquid in the condenser 76 as a result of thermal heat transfer with the environmental air 96. The liquid working fluid from the condenser 76 may flow through the expansion device 78 to the evaporator 80.

The liquid working fluid delivered to the evaporator 80 may absorb heat from another air stream, such as a supply air stream 98 provided to the building 10 or the residence 52. For example, the supply air stream 98 may include ambient or environmental air, return air from a building 10, or a combination of the two. The liquid working fluid in the evaporator 80 may undergo a phase change from the liquid working fluid to a working fluid vapor. In this manner, the evaporator 80 may reduce the temperature of the supply air stream 98 via thermal heat transfer with the working fluid. Thereafter, the vapor working fluid exits the evaporator 80 and returns to the compressor 74 by a suction line to complete the cycle.

In some embodiments, the vapor compression system 72 may further include a reheat coil. In the illustrated embodiment, the reheat coil is represented as part of the evaporator 80. The reheat coil is positioned downstream of the evaporator heat exchanger relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building 10 or other load, embodiments of the present disclosure may be applicable to other HVAC systems as well. For example, the features described herein may be applied to mechanical cooling systems, free cooling systems, chiller systems, or other heat pump or refrigeration applications.

As briefly discussed above, embodiments of the present disclosure are directed to an HVAC system configured to place a working fluid and an air flow in a counterflow arrangement in both a heating mode and a cooling mode of the HVAC system. For example, the HVAC system may be a heat pump (e.g., a central HVAC system, a reversible heat pump) configured to operate in the heating mode and the cooling mode. The heat pump may include a vapor compression circuit configured to circulate the working fluid therethrough (e.g., through at least a portion of the vapor compression circuit) in a first direction in the heating mode and a second direction, opposite the first direction, in the cooling mode. In other words, the vapor compression circuit may be configured to circulate the working fluid along a first flow path (e.g., through components of the vapor compression circuit in a first sequential order) in the heating mode and to circulate the working fluid along a second flow path (e.g., through components of the vapor compression circuit in a second sequential order, different from the first sequential order) in the cooling mode. The vapor compression circuit may further include a valve system configured to direct the working fluid through one or more heat exchangers of the vapor compression circuit in a counterflow arrangement with an air flow directed across the heat exchanger in both the heating mode and the cooling mode. By enabling and providing a counterflow heat transfer arrangement between the working fluid and the air flow in both the heating mode and the cooling mode, the vapor compression circuit (e.g., heat pump) may operate with improved heat transfer efficiency, reduced energy consumption, and greater overall HVAC system efficiency.

Figure 5:
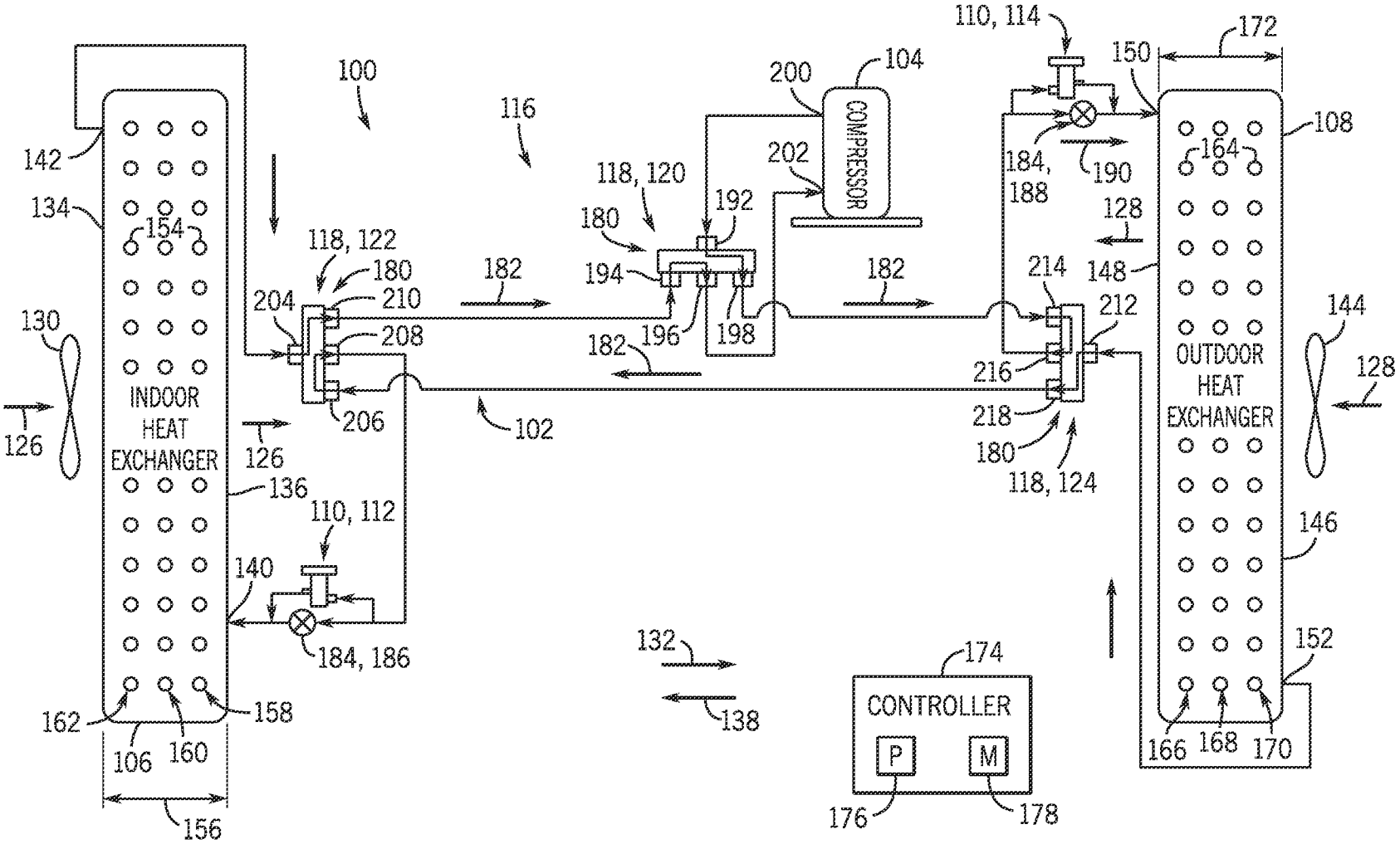
FIG. 5 is a schematic of an embodiment of a heat pump including a valve system, illustrating operation of the heat pump in a cooling mode, in accordance with an aspect of the present disclosure.

To provide context to the following discussion, FIG. 5 is a schematic of an embodiment of a heat pump 100 (e.g., an HVAC system, a central HVAC system, a reversible heat pump, energy efficient heat pump) having a vapor compression circuit 102 (e.g., working fluid circuit) configured to operate in a heating mode and in a cooling mode, in accordance with the present techniques. In the illustrated embodiment, the heat pump 100 is configured for operation in the cooling mode, as discussed further below. The vapor compression circuit 102 may include a compressor 104, a first heat exchanger 106 (e.g., indoor heat exchanger), a second heat exchanger 108 (e.g., outdoor heat exchanger), and one or more expansion valves 110 (e.g., expansion devices, electronic expansion valves), as similarly described above. In particular, the illustrated embodiment of the vapor compression circuit 102 includes a first expansion valve 112 and a second expansion valve 114. The heat pump 100 may be an embodiment of the HVAC unit 12 or the residential heating and cooling system 50 discussed above. In some embodiments, the heat pump 100 may be a central HVAC system configured to condition an air flow (e.g., a supply air flow) by heating and/or cooling the air flow and to discharge the air flow for distribution within a conditioned space, such as the building 10, a home, a plurality of rooms, a plurality of zones, or other space to be conditioned via the air flow.

The vapor compression circuit 102 also includes a valve system 116. The valve system 116 is configured to enable operation of the vapor compression circuit 102 (e.g., the heat pump 100) in the heating mode and in the cooling mode. Specifically, the valve system 116 is configured to adjust a flow direction of the working fluid through the vapor compression circuit 102 to enable adjustment of an operating mode of the heat pump 100. In the illustrated embodiment, the valve system 116 includes three valves 118 (e.g., reversing valves, reversible valves) disposed along the vapor compression circuit 102. That is, the valve system 116 includes a first valve 120, a second valve 122, and a third valve 124. The valves 118 are fluidly coupled to one another along the vapor compression circuit 102. Each of the valves 118 may be a reversible valve and/or a switching valve configured to adjust flow of the working fluid through the respective valve 118 and therefore through vapor compression circuit 102. In particular, one or more of the valves 118 may be operated (e.g., adjusted) to enable flow of the working fluid through the first heat exchanger 106 and/or the second exchanger 108 to place the working fluid in a counterflow heat transfer arrangement with an air flow directed across the corresponding heat exchanger 106, 108 in both the heating mode and the cooling mode of the heat pump 100. For example, the valve system 116 may be controlled to enable flow of the working fluid through the first heat exchanger 106, such that a counterflow heat transfer arrangement is established between the working fluid and a first air flow 126 (e.g., supply air flow) directed across the first heat exchanger 106. Similarly, the valve system 116 may be controlled to enable flow of the working fluid through the second heat exchanger 108, such that a counterflow heat transfer arrangement is established between the working fluid and a second air flow 128 (e.g., ambient air flow, outdoor air flow) directed across the second heat exchanger 108. Indeed, in accordance with present techniques, the valve system 116 is configured to place the working fluid in a counterflow heat transfer arrangement with the first air flow 126 directed across the first heat exchanger 106 and in a counterflow heat transfer arrangement with the second air flow 128 directed across the second heat exchanger 108 in both a heating mode and in a cooling mode of the heat pump 100.

In the illustrated embodiment, the HVAC system 100 includes a first fan 130 configured to direct the first air flow 126 across the first heat exchanger 106 in a first direction 132. That is, the first fan 130 forces the first air flow 126 across the first heat exchanger 106 from a first end 134 (e.g., upstream end) to a second end 136 (e.g., downstream end) of the first heat exchanger 106. As described in further detail below, the valve system 116 is configured to enable flow of the working fluid through the first heat exchanger 106 in a second direction 138 opposite the first direction 132 in both the heating mode and the cooling mode of the heat pump 100. For example, one or more valves 118 of the valve system 116 may be operated to enable the vapor compression circuit 102 to direct the working fluid into the first heat exchanger 106 at the second end 136 and to receive the working fluid from the first heat exchanger 106 at the first end 134 in both the heating mode and the cooling mode of the heat pump 100. That is, the valve system 116 may be operated to enable flow of the working fluid into the first heat exchanger 106 via an inlet port 140 (e.g., first inlet port) of the first heat exchanger 106 at the second end 136 and enable flow of the working fluid out of the first heat exchanger 106 via an outlet port 142 (e.g., first outlet port) of the first heat exchanger 106 at the first end 134 in both the heating mode and the cooling mode of the heat pump 100. In this way, the valve system 116 of the vapor compression circuit 102 is configured to establish a counterflow arrangement between the working fluid and the first air flow 126 at the first heat exchanger 106 in the heating mode and the cooling mode.

In some embodiments, the valve system 116 may also be configured and operated to establish a similar counterflow arrangement between the working fluid and the second air flow 128 directed across the second heat exchanger 108. As shown, the heat pump 100 includes a second fan 144 configured to direct the second air flow 128 across the second heat exchanger 108 in the second direction 138 (e.g., from a first end 146 of the second heat exchanger 108 to a second end 148 of the second heat exchanger 108). To establish the counterflow arrangement, one or more valves 118 of the valve system 116 may be operated to cause the vapor compression circuit 102 to direct the working fluid into the second heat exchanger 108 at the second end 148 and to receive the working fluid from the second heat exchanger 108 at the first end 146 in both the heating mode and the cooling mode of the heat pump 100. That is, the valve system 116 may be operated to enable flow of the working fluid into the second heat exchanger 108 via an inlet port 150 (e.g., second inlet port) of the second heat exchanger 108 at the second end 148 and enable flow of the working fluid out of the second heat exchanger 108 via an outlet port 152 (e.g., second outlet port) of the second heat exchanger 108 at the first end 146 in both the heating mode and the cooling mode of the heat pump 100. Thus, the valve system 116 of the vapor compression circuit 102 is configured to establish a counterflow arrangement between the working fluid and the second air flow 128 at the second heat exchanger 108 in the heating mode and the cooling mode.

In some embodiments, the first heat exchanger 106 and/or the second heat exchanger 108 may be a tube and fin type heat exchanger. For example, the first heat exchanger 106 may include one or more tubes 154 configured to direct working fluid therethrough and one or more fins attached to the tubes 154. The tubes 154 cooperatively extend from the inlet port 140 to the outlet port 142, such that the tubes 154 direct the working fluid from the second end 136 to the first end 134 in the second direction 138. In some embodiments, the tubes 154 may be arranged in a plurality of rows arrayed along a width or depth 156 of the first heat exchanger 106. For example, in the illustrated embodiment, working fluid may be directed into the first heat exchanger 106 via the inlet port 140 and sequentially directed through a first row 158 of tubes 154, a second row 160 of tubes 154, and a third row 162 of tubes 154. In this way, the working fluid flows through the tubes 154 of the first heat exchanger 106 from the second end 136 to the first end 134 and in the second direction 138 (e.g., opposite the first direction 132 of the first air flow 126 directed across the first heat exchanger 106). The third row 162 of tubes 154 may be fluidly coupled to the outlet port 142, such that the working fluid may be discharged from the first heat exchanger 106 via the outlet port 142 to continue circulation through the vapor compression circuit 102.

In some embodiments, the second heat exchanger 108 may be configured in a similar manner as the first heat exchanger 106. For example, the second heat exchanger 108 may include one or more tubes 164 configured to direct working fluid therethrough, and the tubes 164 may cooperatively extend from the inlet port 150 to the outlet port 152 of the second heat exchanger 108, such that the tubes 164 direct the working fluid from the second end 148 to the first end 146 in the first direction 132. The tubes 164 may be arranged in a plurality of rows, such as a first row 166, a second row 168, and a third row 170, arrayed along a width or depth 172 of the second heat exchanger 108. Accordingly, working fluid may be directed into the second heat exchanger 108 via the inlet port 150 and directed sequentially through the first row 166 of tubes 164, the second row 168 of tubes 164, and the third row 170 of tubes 164 from the second end 148 to the first end 146 and in the first direction 132 (e.g., opposite the second direction 138 of the second air flow 128 directed across the second heat exchanger 108). The third row 170 of tubes 164 may be fluidly coupled to the outlet port 152, such that the working fluid may be discharged from the second heat exchanger 108 via the outlet port 152 to continue circulation through the vapor compression circuit 102.

It should be appreciated that other embodiments of the heat pump 100 may be configured to direct the working fluid through the first and/or second heat exchangers 106, 108 and to direct the first and/or second air flows 126, 128 across the corresponding heat exchanger 106, 108 in directions other than those described herein (e.g., first direction 132, second direction 138) to place the working fluid in a counterflow heat transfer arrangement with the air flows 126, 128. For example, the first heat exchanger 106 may be configured to direct the working fluid therethrough (e.g., from the inlet port 140 to the outlet port 142 via the tubes 154) in the first direction 132, and the first fan 130 may be configured to direct the first air flow 126 across the first heat exchanger 106 in the second direction 138 to establish a counterflow arrangement between the first air flow 126 and the working fluid. Similarly, the second heat exchanger 108 may be configured to direct the working fluid therethrough (e.g., from the inlet port 150 to the outlet port 152 via the tubes 164) in the second direction 138, and the second fan 144 may be configured to direct the second air flow 128 across the second heat exchanger 108 in the first direction 132 to establish a counterflow arrangement between the second air flow 128 and the working fluid.

The valve system 116 is configured to enable flow of the working fluid through the first heat exchanger 106 and/or the second heat exchanger 108 in the manner described above in both a heating mode and a cooling mode of the heat pump 100. Positions and/or configurations of one or more of the valves 118 may be adjusted to enable selective operation of the vapor compression circuit 102 in the heating mode and in the cooling mode. To this end, the valve system 116 (e.g., each valve 118) may be communicatively coupled to a controller 174 (e.g., a control system, a thermostat, a control panel, control circuitry). The controller 174 is configured to monitor, adjust, and/or otherwise control operation of the components of the heat pump 100 (e.g., vapor compression circuit 102). For example, one or more control transfer devices, such as wires, cables, wireless communication devices, and the like, may communicatively couple the compressor 104, the expansion valves 110, the first and/or second fans 130, 144, the control device 16 (e.g., a thermostat), the valves 118 and/or any other suitable components of the heat pump 100. The compressor 104, the expansion valves 110, the first and/or second fans 130, 144, the control device 16, and/or the valve system 116 (e.g., valves 118) may each have one or more communication components that facilitate wired or wireless (e.g., via a network) communication with the controller 174. In some embodiments, the communication components may include a network interface that enables the components of the heat pump 100 to communicate via various protocols such as EtherNet/IP, ControlNet, DeviceNet, or any other communication network protocol. Alternatively, the communication components may enable the components of the heat pump 100 to communicate via mobile telecommunications technology, Bluetooth®, near-field communications technology, and the like. As such, the compressor 104, the expansion valves 110, the first and/or second fans 130, 144, the control device 16, and/or the valve system 116 may wirelessly communicate data between each other. In other embodiments, operational control of certain components of the heat pump 100 may be regulated by one or more relays or switches (e.g., a 24 volt alternating current [VAC] relay).

In some embodiments, the controller 174 may be a component of or may include the control panel 82. In other embodiments, the controller 174 may be a standalone controller, a dedicated controller, or another suitable controller included in the heat pump 100. In any case, the controller 174 is configured to control components of the heat pump 100 in accordance with the techniques discussed herein. The controller 174 includes processing circuitry 176, such as a microprocessor, which may execute software for controlling the components of the heat pump 100. The processing circuitry 176 may include multiple microprocessors, one or more "general-purpose" microprocessors, one or more special-purpose microprocessors, and/or one or more application specific integrated circuits (ASICS), or some combination thereof. For example, the processing circuitry 176 may include one or more reduced instruction set (RISC) processors.

The controller 174 may also include a memory device 178 (e.g., a memory) that may store information, such as instructions, control software, look up tables, configuration data, and so forth. The memory device 178 may include a volatile memory, such as random access memory (RAM), and/or a nonvolatile memory, such as read-only memory (ROM). The memory device 178 may store a variety of information and may be used for various purposes. For example, the memory device 178 may store processor-executable instructions including firmware or software for the processing circuitry 176 execute, such as instructions for controlling components of the heat pump 100. In some embodiments, the memory device 178 is a tangible, non-transitory, machine-readable-medium that may store machine-readable instructions for the processing circuitry 176 to execute. The memory device 178 may include ROM, flash memory, a hard drive, or any other suitable optical, magnetic, or solid-state storage medium, or a combination thereof. The memory device 178 may store data, instructions, and any other suitable data.

In the illustrated embodiment, the valve system 116 is positioned in a first configuration 180 to enable operation of the vapor compression circuit 102 in the cooling mode and to also establish counterflow heat transfer arrangements between the working fluid and the first and second air flows 126, 128 (e.g., via the first and second heat exchangers 106, 108). For example, each valve 118 of the valve system 116 may be positioned in a first configuration (e.g., a first position, first configuration 180) to enable operation of the heat pump 100 in the cooling mode. The controller 174 may output control signals to the valve system 116 (e.g., the valves 118) to adjust the valve system 116 to the first configuration 180 to enable operation of the heat pump 100 in the cooling mode. For example, the controller 174 may instruct the valve system 116 (e.g., valves 118) to adjust (e.g., simultaneously adjust) to the first configuration 180 in response to a call for cooling received from the control device 16 (e.g., thermostat). Additionally, in the cooling mode, the controller 174 may adjust the second expansion valve 114 to a closed position and may adjust the first expansion valve 112 to an at least partially open position to enable flow of the working fluid through the first expansion valve 112.

In the first configuration 180, the valve system 116 is configured to direct the working fluid along the vapor compression circuit 102 (e.g., at least a portion of the vapor compression circuit 102) in a first flow direction 182. In particular, each of the valves 118 may be positioned in the first configuration 180 to enable flow of the working fluid in the first flow direction 182. Details of the valves 118 positioned in the first configuration 180 are described further below. As the working fluid flows along the vapor compression circuit 102 in the cooling mode, the working fluid flows sequentially through the compressor 104, the second heat exchanger 108, the first expansion valve 112, and the first heat exchanger 106, as well as the first, second, and third valves 120, 122, and 124 disposed therebetween. It should be noted that the vapor compression circuit 102 may also include one or more flow control valves 184 (e.g., a first check valve 186, a second check valve 188, solenoid valves). The first check valve 186 is arranged in parallel with the first expansion valve 112 along the vapor compression circuit 102, and the second check valve 188 is arranged in parallel with the second expansion valve 114 along the vapor compression circuit 102. The flow control valves 184 may enable desired or intended flow of the working fluid through the vapor compression circuit 102 during instances in which one of the expansion valves 110 is adjusted to a closed position. For example, with the second expansion valve 114 adjusted to the closed position in the cooling mode, the second check valve 188 may enable flow of the working fluid to the inlet port 150 of the second heat exchanger 108, as indicated by arrow 190.

As will be appreciated, in the cooling mode the second heat exchanger 108 (e.g., outdoor heat exchanger) may operate as a condenser to condense and cool the working fluid via the counterflow heat transfer arrangement established between the working fluid and the second air flow 128 (e.g., ambient air flow), while the first heat exchanger 106 (e.g., indoor heat exchanger) may operate as an evaporator to evaporate and heat the working fluid via the counterflow heat transfer arrangement established between the working fluid and the first air flow 126 (e.g., supply air flow). In this way, the vapor compression circuit 102 may operate in the cooling mode to cool the first air flow 126 for supply to a conditioned space.

In the illustrated embodiment, the first valve 120 (e.g., reversing valve, four-way valve) includes a first port 192, a second port 194, a third port 196, and a fourth port 198. In the first configuration 180 of the valve system 116 (e.g., the first valve 120), the first valve 120 is configured to receive a flow (e.g., first flow) of working fluid from a discharge port 200 of the compressor 104 via the first port 192 and to discharge the flow of working fluid via the fourth port 198 (e.g., to direct the flow of working fluid toward the second heat exchanger 108). The first valve 120 is also configured to receive a flow (e.g., second flow) of the working fluid via the second port 194 (e.g., from the first heat exchanger 106) and to discharge the flow of working fluid via the third port 196 (e.g., to direct the flow of working fluid toward a suction port 202 of the compressor 104). Thus, in the first configuration 180, the first port 192 and the fourth port 198 are fluidly coupled to one another, the second port 194 and the third port 196 are fluidly coupled to one another, and the first port 192 and the fourth port 198 are fluidly isolated from the second port 194 and the third port 196.

The second valve 122 (e.g., reversing valve, four-way valve) similarly includes a first port 204, a second port 206, a third port 208, and a fourth port 210. In the first configuration 180 of the valve system 116 (e.g., the second valve 122), the second valve 122 is configured to receive a flow (e.g., first flow) of working fluid from the outlet port 142 of the first heat exchanger 106 and to discharge the flow of working fluid via the fourth port 210. As shown, the fourth port 210 of the second valve 122 is fluidly coupled, via the vapor compression circuit 102, to the second port 194 of the first valve 120 in the first configuration 180 of the valve system 116. Thus, the working fluid discharged via the fourth port 210 of the second valve 122 may be directed to the compressor 104 via the second and third ports 194, 196 of the first valve 120. In the first configuration 180, the second valve 122 is also configured to receive a flow (e.g., second flow) of the working fluid via the second port 206 (e.g., from the second heat exchanger 108, via the third valve 124) and to discharge the flow of working fluid via the third port 208. The working fluid discharged from the third port 208 of the second valve 122 is directed, via the vapor compression circuit 102, through the first expansion valve 112 and to the inlet port 140 of the first heat exchanger 106. Thus, in the first configuration 180, the first port 204 and the fourth port 210 are fluidly coupled to one another, the second port 206 and the third port 208 are fluidly coupled to one another, and the first port 204 and the fourth port 210 are fluidly isolated from the second port 206 and the third port 208.

The third valve 124 (e.g., reversing valve, four-way valve) also includes a first port 212, a second port 214, a third port 216, and a fourth port 218. In the first configuration 180 of the valve system 116 (e.g., the third valve 124), the third valve 124 is configured to receive a flow (e.g., first flow) of working fluid from the outlet port 152 of the second heat exchanger 108 and to discharge the flow of working fluid via the fourth port 218. As shown, the fourth port 218 of the third valve 124 is fluidly coupled, via the vapor compression circuit 102, to the second port 206 of the second valve 122 in the first configuration 180 of the valve system 116. Thus, the working fluid discharged via the fourth port 218 of the third valve 124 may be directed to the first expansion valve 112 and the first heat exchanger 106 via the second and third ports 206, 208 of the second valve 122. In the first configuration 180, the third valve 124 is also configured to receive a flow (e.g., second flow) of the working fluid via the second port 214 (e.g., from the compressor 104, via the first valve 120) and to discharge the flow of working fluid via the third port 216. The working fluid discharged from the third port 216 of the third valve 124 is directed, via the vapor compression circuit 102, through the second check valve 188 and to the inlet port 150 of the second heat exchanger 108. Thus, in the first configuration 180, the first port 212 and the fourth port 218 are fluidly coupled to one another, the second port 214 and the third port 216 are fluidly coupled to one another, and the first port 212 and the fourth port 218 are fluidly isolated from the second port 214 and the third port 216.

Accordingly, in the first configuration 180, the valve system 116 (e.g., the valves 118) is configured to direct the working fluid through the vapor compression circuit 102 to enable the cooling mode of the heat pump 100 (e.g., to cool the first air flow 126, supply air flow) and to also place the working fluid in a counterflow arrangement with the first air flow 126 directed across the first heat exchanger 106 and in a counterflow arrangement with the second air flow 128 (e.g., ambient air flow) directed across the second heat exchanger 108. By establishing a counterflow heat exchange relationship between the working fluid circulated through the first and second heat exchangers 106, 108 and the corresponding air flows 126, 128 in the cooling mode of the heat pump 100, the valve system 116 enables improved efficiency of the heat pump 100 (e.g., increased heat transfer efficiency, increased energy efficiency, reduced energy consumption).

Figure 6:
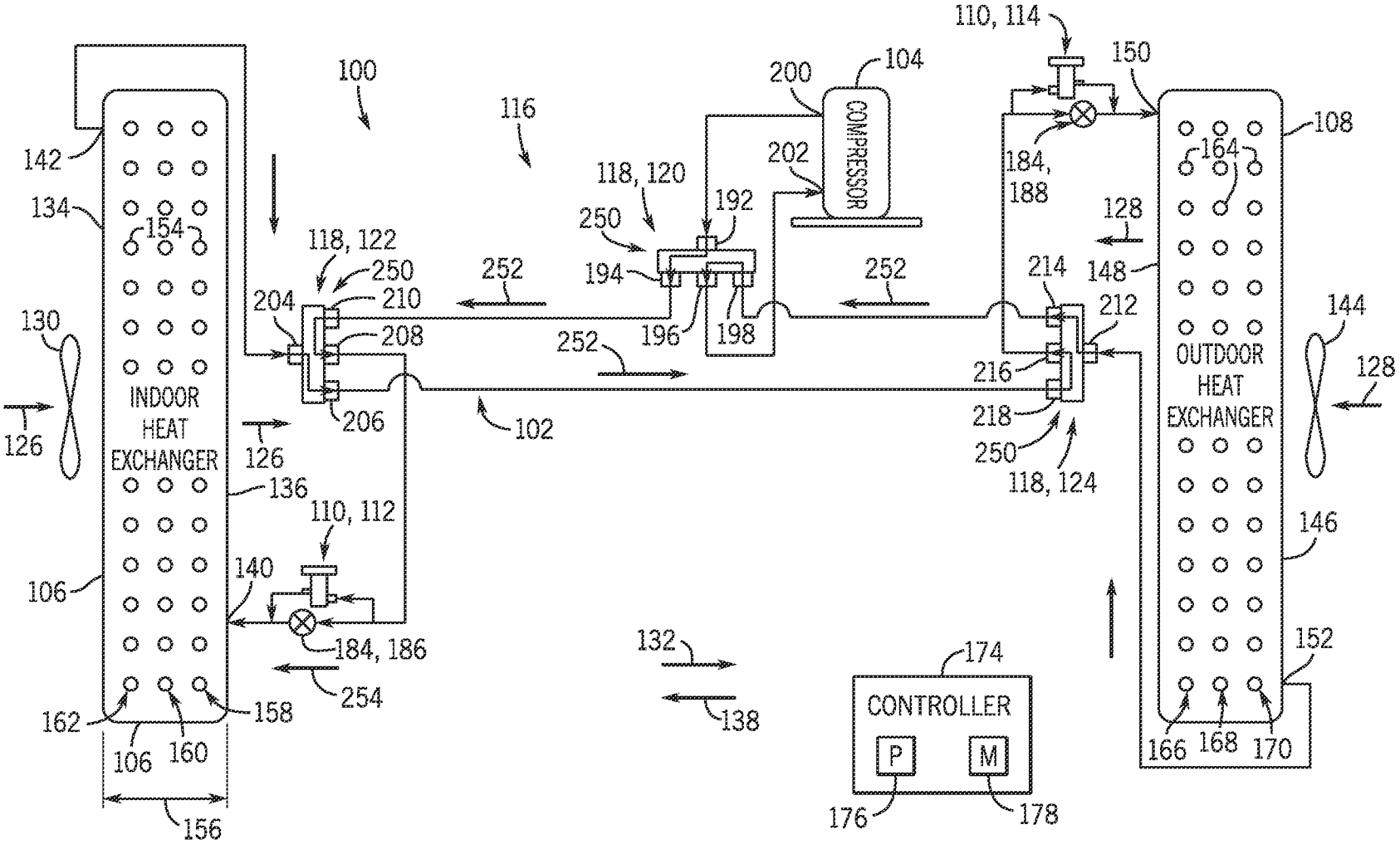
FIG. 6 is a schematic of an embodiment of a heat pump including a valve system, illustrating operation of the heat pump in a heating mode, in accordance with an aspect of the present disclosure.

FIG. 6 is a schematic of an embodiment of the heat pump 100 (e.g., a heat pump, a central HVAC system, a reversible heat pump, energy efficient heat pump) including an embodiment of the valve system 116, in accordance with the present techniques, and illustrating the heat pump 100 configured for operation in a heating mode (e.g., to heat the first air flow 126). The illustrated embodiment includes similar elements and element numbers as those described above with reference to FIG. 5. For example, the valve system 116 includes the first valve 120, the second valve 122, and the third valve 124. To enable operation of the heat pump 100 in the heating mode, the valve system 116 is positioned in a second configuration 250. That is, each valve 118 of the valve system 116 may be positioned in the second configuration 250. In the second configuration 250, the valve system 116 is also configured to establish counterflow heat transfer arrangements between the working fluid and the first and second air flows 126, 128 (e.g., via the first and second heat exchangers 106, 108). The controller 174 may output control signals to the valve system 116 (e.g., the valves 118) to adjust the valve system 116 to the second configuration 250 to enable operation of the heat pump 100 in the heating mode. For example, the controller 174 may instruct the valve system 116 (e.g., the valves 118) to adjust (e.g., simultaneously adjust) to the second configuration 250 in response to a call for heating received from the control device 16 (e.g., thermostat). Additionally, in the heating mode, the controller 174 may adjust the first expansion valve 112 to a closed position and may adjust the second expansion valve 114 to an at least partially open position to enable flow of the working fluid through the second expansion valve 114.

In the second configuration 250, the valve system 116 is configured to direct the working fluid along the vapor compression circuit 102 (e.g., at least a portion of the vapor compression circuit 102) in a second flow direction 252 (e.g., opposite the first flow direction 182). In particular, each of the valves 118 may be positioned in the second configuration 250 to enable flow of the working fluid in the second flow direction 252. Details of the valves 118 positioned in the second configuration 250 are described further below. As the working fluid flows along the vapor compression circuit 102 in the second flow direction 252, the working fluid flows sequentially through the compressor 104, the first heat exchanger 106, the second expansion valve 114, and the second heat exchanger 108, as well as the first, second, and third valves 120, 122, and 124 disposed therebetween. Additionally, with the first expansion valve 112 adjusted to the closed position in the heating mode, the first check valve 186 may enable flow of the working fluid to the inlet port 140 of the first heat exchanger 106, as indicated by arrow 254.

As will be appreciated, in the heating mode the first heat exchanger 106 (e.g., indoor heat exchanger) may operate as a condenser to condense and cool the working fluid via the counterflow heat transfer arrangement established between the working fluid and the first air flow 126 (e.g., supply air flow), while the second heat exchanger 108 (e.g., outdoor heat exchanger) may operate as an evaporator to evaporate and heat the working fluid via the counterflow heat transfer arrangement established between the working fluid and the second air flow 128 (e.g., ambient air flow). In this way, the vapor compression circuit 102 may operate in the heating mode to heat the first air flow 126 for supply to a conditioned space.

In the second configuration 250 of the valve system 116 (e.g., the first valve 120), the first port 192 of the first valve 120 is configured to receive a flow (e.g., first flow) of working fluid from the discharge port 200 of the compressor 104 and to discharge the flow of working fluid via the second port 194 (e.g., to direct the flow of working fluid toward the first heat exchanger 106). The first valve 120 is also configured to receive a flow (e.g., second flow) of the working fluid via the fourth port 198 (e.g., from the second heat exchanger 108) and to discharge the flow of working fluid via the third port 196 (e.g., to direct the flow of working fluid toward the suction port 202 of the compressor 104). Thus, in the second configuration 250, the first port 192 and the second port 194 are fluidly coupled to one another, the fourth port 198 and the third port 196 are fluidly coupled to one another, and the first port 192 and the second port 194 are fluidly isolated from the fourth port 198 and the third port 196.

In the second configuration 250 of the valve system 116 (e.g., the second valve 122), the first port 204 of the second valve 122 is configured to receive a flow (e.g., first flow) of working fluid from the outlet port 142 of the first heat exchanger 106 and to discharge the flow of working fluid via the second port 206 (e.g., to direct the flow of working fluid toward the second expansion valve 114 and the inlet port 150 of the second heat exchanger 108). In the second configuration 250, the second valve 122 is also configured to receive a flow (e.g., second flow) of the working fluid via the fourth port 210 and to discharge the flow of working fluid via the third port 208. As shown, the fourth port 210 of the second valve 122 is fluidly coupled, via the vapor compression circuit 102, to the second port 194 of the first valve 120 in the second configuration 250 of the valve system 116. Thus, the working fluid discharged via the second port 194 of the first valve 120 may be directed to the first check valve 186 and the inlet port 140 of the first heat exchanger 106 via the fourth and third ports 210, 208 of the second valve 122. Thus, in the second configuration 250, the first port 204 and the second port 206 are fluidly coupled to one another, the fourth port 210 and the third port 208 are fluidly coupled to one another, and the first port 204 and the second port 206 are fluidly isolated from the fourth port 210 and the third port 208.

In the second configuration 250 of the valve system 116 (e.g., the third valve 124), the first port 212 of the third valve 124 is configured to receive a flow (e.g., first flow) of working fluid from the outlet port 152 of the second heat exchanger 108 and to discharge the flow of working fluid via the second port 214. As shown, the second port 214 of the third valve 124 is fluidly coupled, via the vapor compression circuit 102, to the fourth port 198 of the first valve 120 in the second configuration 250 of the valve system 116. Thus, the working fluid discharged via the second port 214 of the third valve 124 may be directed to the suction port 202 of the compressor 104 via the fourth and third ports 198, 196 of the first valve 120. In the second configuration 250, the third valve 124 is also configured to receive a flow (e.g., second flow) of the working fluid via the fourth port 218 (e.g., from the first heat exchanger 106, via the second valve 122) and to discharge the flow of working fluid via the third port 216. The working fluid discharged from the third port 216 of the third valve 124 is directed, via the vapor compression circuit 102, through the second expansion valve 114 and to the inlet port 150 of the second heat exchanger 108. Thus, in the second configuration 250, the first port 212 and the second port 214 are fluidly coupled to one another, the fourth port 218 and the third port 216 are fluidly coupled to one another, and the first port 212 and the second port 214 are fluidly isolated from the fourth port 218 and the third port 216.

Accordingly, in the second configuration 250, the valve system 116 (e.g., the valves 118) is configured to direct the working fluid through the vapor compression circuit 102 to enable the heating mode of the heat pump 100 (e.g., to heat the first air flow 126, supply air flow) and to also place the working fluid in a counterflow arrangement with the first air flow 126 directed across the first heat exchanger 106 and in a counterflow arrangement with the second air flow 128 (e.g., ambient air flow) directed across the second heat exchanger 108. By establishing a counterflow heat exchange relationship between the working fluid circulated through the first and second heat exchangers 106, 108 and the corresponding air flows 126, 128 in the heating mode of the heat pump 100, the valve system 116 enables improved efficiency of the heat pump 100 (e.g., increased heat transfer efficiency, increased energy efficiency, reduced energy consumption). Indeed, the vapor compression circuit 102 having the valve system 116 is configured to operate with reduced greenhouse gas emissions by operating to heat and cool an air flow in an energy efficient manner and without operation of a furnace or other system that consumes a fuel.

It should be appreciated that the valve system 116 having the first, second, and third valves 120, 122, and 124 may be incorporated in any suitable embodiment of the heat pump 100 (e.g., HVAC system) to enable counterflow heat exchange relationships between the working fluid circulated through the first and second heat exchangers 106, 108 and the corresponding air flows 126, 128 in both the heating mode and the cooling mode. For example, the embodiments discussed above may be incorporated in a packaged unit (e.g., HVAC unit 12) that may conveniently accommodate the first, second, and third valves 120, 122, and 124 and the associated conduits of the vapor compression circuit 102 extending therebetween. Furthermore, it should be appreciated that some embodiments of the valve system 116 may include the first valve 120 and the second valve 122 without the third valve 124 (e.g., to enable the counterflow arrangement via the first heat exchanger 106 in the heating mode and the cooling mode), while other embodiments of the valve system 116 may include the first valve 120 and the third valve 124 without the second valve 122 (e.g., to enable the counterflow arrangement via the second heat exchanger 108 in the heating mode and the cooling mode).

Figure 7:
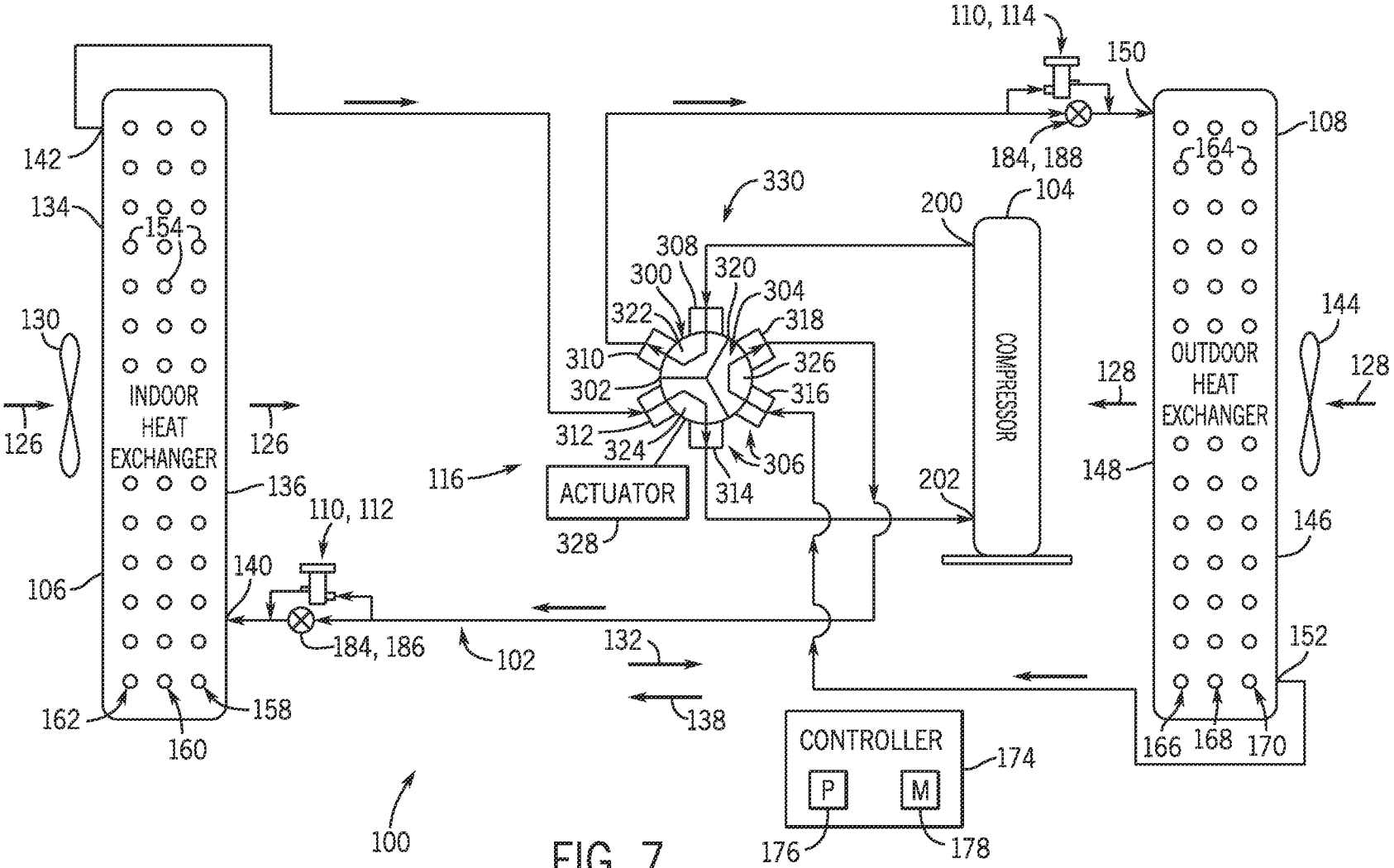
FIG. 7 is a schematic of an embodiment a heat pump including a valve system, illustrating operation of the heat pump in a cooling mode, in accordance with an aspect of the present disclosure.

FIG. 7 is a schematic of an embodiment of the heat pump 100 (e.g., an HVAC system, a central HVAC system, a reversible heat pump, an energy efficient heat pump) having the vapor compression circuit 102 (e.g., working fluid circuit) configured to operate in a heating mode and in a cooling mode, in accordance with the present techniques. The heat pump 100 also includes an embodiment of the valve system 116. Specifically, the valve system 116 includes a valve 300 (e.g., a hexa-valve, a six-way valve, switching valve, a single valve) disposed along the vapor compression circuit 102 and configured to adjust a flow direction and/or a flow path of the working fluid through the vapor compression circuit 102 to enable adjustment of an operating mode of the heat pump 100. The valve 300 is also configured to enable counterflow heat transfer arrangements between the working fluid and multiple air flows. The illustrated embodiment also includes elements and element numbers similar to those described above with reference to FIGS. 5 and 6, such as the compressor 104, the first heat exchanger 106, the second heat exchanger 108, the expansion valves 110, the flow control valves 184, and the controller 174.

The valve 300 includes a housing 302 defining an internal volume 304 configured to receive and direct flows of working fluid therethrough. The valve 300 also includes a plurality of ports 306 (e.g., openings, inlets, outlets) configured to direct working fluid into the internal volume 304 and/or discharge working fluid from the internal volume 304 (e.g., based on a configuration of the valve 300). In particular, the valve 300 includes a first port 308, a second port 310, a third port 312, a fourth port 314, a fifth port 316, and a sixth port 318. A divider 320 (e.g., baffle, partition, plate, barrier, three-way divider, etc.) is disposed within the internal volume 304 (e.g., within the housing 302) and is configured to divide the internal volume 304 into a plurality of chambers (e.g., a first chamber 322, a second chamber 324, and a third chamber 326).

The divider 320 is configured to fluidly couple at least two of the ports 306 and to fluidly separate the at least two ports 306 from remaining ports 306 of the valve 300 (e.g., via sealing engagement between the divider 320 and the housing 302). In this way, the divider 320 enables receipt and discharge of multiple flows of the working fluid through the valve 300. A position of the divider 320 within the housing 302 is adjustable to enable fluid coupling of different ports 306 within one another (e.g., in different operating modes of the heat pump 100). In this way, flow of the working fluid through the vapor compression circuit 102 may be adjusted (e.g., to transition operation of the heat pump 100 between the heating mode and the cooling mode). The position of the divider 320 may be adjusted by an actuator 328. The actuator 328 may be an electromechanical actuator, a magnetic actuator, a rotary actuator, a hydraulic actuator, a pneumatic actuator, another suitable actuator, or any combination thereof. The actuator 328 may also be communicatively coupled to the controller 174. The controller 174 may be configured to adjust the position of the divider 320 within the internal volume 304 to enable operation of the heat pump 100 in different operating modes (e.g., heating mode, cooling mode), such as based on a signal, instruction, or data received from the control device 16 (e.g., thermostat).

In the illustrated embodiment, the valve 300 is positioned in a first configuration 330 (e.g., the divider 320 is in a first position within the housing 302) to enable operation of the heat pump 100 in the cooling mode. In the first configuration 330, the divider 320 fluidly couples the first port 308 and the second port 310 via the first chamber 322 and fluidly isolates the first port 308 and the second port 310 from the third port 312, the fourth port 314, the fifth port 316, and the sixth port 318. The divider 320 also fluidly couples the third port 312 and the fourth port 314 via the second chamber 324 and fluidly isolates the third port 312 and the fourth port 314 from the first port 308, the second port 310, the fifth port 316, and the sixth port 318. The divider 320 further fluidly couples the fifth port 316 and the sixth port 318 via the third chamber 326 and fluidly isolates the fifth port 316 and the sixth port 318 from the first port 308, the second port 310, the third port 312, and the fourth port 314.

As mentioned above, the valve 300 in the first configuration 330 enables operation of the heat pump 100 in the cooling mode. For example, in the first configuration 330, the valve 300 is configured to receive a flow of working fluid (e.g., a first flow) from the discharge port 200 of the compressor 104 via the first port 308. The valve 300 may direct the flow of working fluid from the first port 308, through the first chamber 322, and out of the first chamber 322 via the second port 310 to direct the flow of working fluid toward the second heat exchanger 108 (e.g., operating as a condenser). In the cooling mode, the second expansion valve 114 may be adjusted to a closed position (e.g., via the controller 174), such that the working fluid may flow from the second port 310 of the valve 300 to the inlet port 150 of the second heat exchanger 108 via the second check valve 188.

As similarly discussed above, the working fluid may flow from the inlet port 150 of the second heat exchanger 108, through the tubes 164 of the second heat exchanger 108 (e.g., in the first direction 132), and out of the second heat exchanger 108 via the outlet port 152. Thus, the second heat exchanger 108 may place the working fluid in a counterflow heat transfer arrangement with the second air flow 128 directed across the second heat exchanger 108 (e.g., via the second fan 144) in the second direction 138. From the outlet port 152 of the second heat exchanger 108, the vapor compression circuit 102 may direct the working fluid to the valve 300. Specifically, the valve 300 may receive a flow (e.g., second flow) of working fluid from the second heat exchanger 108 via the fifth port 316. In the first configuration 330, the valve 300 may direct the flow of working fluid from the fifth port 316, through the third chamber 326, and out of the third chamber 326 via the sixth port 318 to direct the flow of working fluid toward the first heat exchanger 106. In particular, the flow of working fluid discharged via the sixth port 318 may be directed along the vapor compression circuit 102 and through the first expansion valve 112 to flow to the first heat exchanger 106 (e.g., operating as an evaporator). Accordingly, in the cooling mode, the controller 174 may adjust the first expansion valve 112 to an at least partially open position.

From the first expansion valve 112, the working fluid is directed by the vapor compression circuit 102 to the inlet port 140 of the first heat exchanger 106. As similarly described above, the working fluid may flow from the inlet port 140 of the first heat exchanger 106, through the tubes 154 of the first heat exchanger 106 (e.g., in the second direction 138), and out of the first heat exchanger 106 via the outlet port 142. Thus, the first heat exchanger 106 may place the working fluid in a counterflow heat transfer arrangement with the first air flow 126 directed across the first heat exchanger 106 (e.g., via the first fan 130) in the first direction 132. From the outlet port 142 of the first heat exchanger 106, the vapor compression circuit 102 may direct the working fluid to the valve 300. Specifically, the valve 300 may receive a flow (e.g., third flow) of the working fluid from the first heat exchanger 106 via the third port 312. In the first configuration 330, the valve 300 may direct the flow of working fluid from the third port 312, through the second chamber 324, and out of the second chamber 324 via the fourth port 314 to direct the flow of working fluid toward the suction port 202 of the compressor 104.

Accordingly, in the first configuration 330, the valve 300 is configured to direct the working fluid through the vapor compression circuit 102 to enable the cooling mode of the heat pump 100 (e.g., to cool the first air flow 126, supply air flow) and to also place the working fluid in a counterflow arrangement with the first air flow 126 directed across the first heat exchanger 106 and in a counterflow arrangement with the second air flow 128 (e.g., ambient air flow) directed across the second heat exchanger 108. By establishing a counterflow heat exchange relationship between the working fluid circulated through the first and second heat exchangers 106, 108 and the corresponding air flows 126, 128 in the cooling mode of the heat pump 100, the valve 300 enables improved efficiency of the heat pump 100 (e.g., increased heat transfer efficiency, increased energy efficiency, reduced energy consumption).

Figure 8:
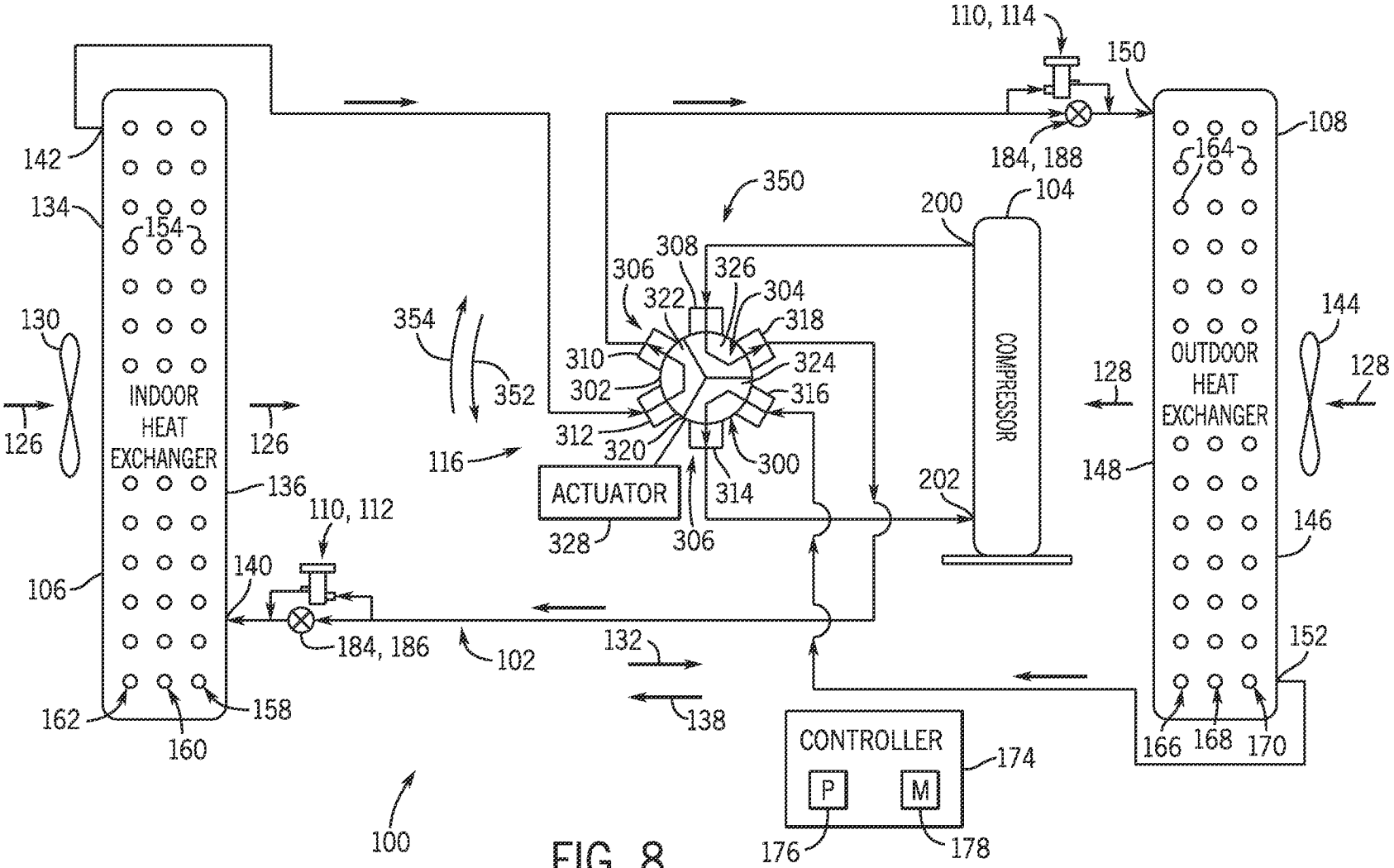
FIG. 8 is a schematic of an embodiment of a heat pump including a valve system, illustrating operation of the heat pump in a cooling mode, in accordance with an aspect of the present disclosure.

FIG. 8 is a schematic of an embodiment of the heat pump 100 (e.g., an HVAC system, a central HVAC system, a reversible heat pump, an energy efficient heat pump) having the vapor compression circuit 102 (e.g., working fluid circuit) and the valve system 116 including the valve 300 (e.g., a hexa-valve, a six-way valve, switching valve, a single valve) disposed along the vapor compression circuit 102. In the illustrated embodiment, the valve 300 is positioned in a second configuration 350 (e.g., the divider 320 is in a second position within the housing 302) to enable operation of the heat pump 100 in the heating mode. As discussed above, the actuator 328 may adjust a position of the divider 320 within the housing 302 to enable transition of the divider 320 between the first configuration 330 and the second configuration 350. For example, the actuator 328 may rotate the divider 320 within the housing 302 to transition of the divider 320 between the first configuration 330 and the second configuration 350. In some embodiments, the actuator 328 may rotate the actuator 328 in a counter-clockwise direction 352 (e.g., by approximately 60 degrees) to transition the valve 300 from the first configuration 330 to the second configuration 350. To transition the valve 300 from the second configuration 350 to the first configuration 330, the actuator 328 may rotate the valve 300 (e.g., by approximately 60 degrees) in a clockwise direction 354, or the actuator 328 may rotate the valve 300 (e.g., by approximately 60 degrees) in the counter-clockwise direction 352. As similarly discussed above, the controller 174 may control the actuator 328 to transition the valve 300 (e.g., the divider 320) to the second configuration 350 in response to receipt of a call for heating (e.g., from the control device 16).

In the second configuration 350, the divider 320 fluidly couples the first port 308 and the sixth port 318 via the third chamber 326 and fluidly isolates the first port 308 and the sixth port 318 from the second port 310, the third port 312, the fourth port 314, and the fifth port 316. The divider 320 also fluidly couples the second port 310 and the third port 312 via the first chamber 322 and fluidly isolates the second port 310 and the third port 312 from the first port 308, the fourth port 314, the fifth port 316, and the sixth port 318. The divider 320 further fluidly couples the fourth port 314 and the fifth port 316 via the second chamber 324 and fluidly isolates the fourth port 314 and the fifth port 316 from the first port 308, the second port 310, the third port 312, and the sixth port 318.

As mentioned above, the valve 300 in the second configuration 350 enables operation of the heat pump 100 in the heating mode. For example, in the second configuration 350, the valve 300 is configured to receive a flow of working fluid (e.g., a first flow) from the discharge port 200 of the compressor 104 via the first port 308. The valve 300 may direct the flow of working fluid from the first port 308, through the third chamber 326, and out of the third chamber 326 via the sixth port 318 to direct the flow of working fluid toward the first heat exchanger 106 (e.g., operating as a condenser). In the heating mode, the first expansion valve 112 may be adjusted to a closed position (e.g., via the controller 174), such that the working fluid may flow from the sixth port 318 of the valve 300 to the inlet port 140 of the first heat exchanger 106 via the first check valve 186.

As discussed above, the working fluid may flow from the inlet port 140 of the first heat exchanger 106, through the tubes 154 of the first heat exchanger 106 (e.g., in the second direction 138), and out of the first heat exchanger 106 via the outlet port 142. Thus, the first heat exchanger 106 may place the working fluid in a counterflow heat transfer arrangement with the first air flow 126 directed across the first heat exchanger 106 (e.g., via the first fan 130) in the first direction 132. From the outlet port 142 of the first heat exchanger 106, the vapor compression circuit 102 may direct the working fluid to the valve 300. Specifically, the valve 300 may receive the flow (e.g., second flow) of working fluid from the first heat exchanger 106 via the third port 312. In the second configuration 350, the valve 300 may direct the flow of working fluid from the third port 312, through the first chamber 322, and out of the first chamber 322 via the second port 310 to direct the flow of working fluid toward the second heat exchanger 108. In particular, the flow of working fluid discharged via the second port 310 may be directed along the vapor compression circuit 102 and through the second expansion valve 114 to flow to the second heat exchanger 108 (e.g., operating as an evaporator). Accordingly, in the heating mode, the controller 174 may adjust the second expansion valve 114 to an at least partially open position to enable flow of working fluid therethrough.

From the second expansion valve 114, the working fluid is directed by the vapor compression circuit 102 to the inlet port 150 of the second heat exchanger 108. As similarly described above, the working fluid may flow from the inlet port 150 of the second heat exchanger 108, through the tubes 164 of the second heat exchanger 108 (e.g., in the first direction 132), and out of the second heat exchanger 108 via the outlet port 152. Thus, the second heat exchanger 108 may place the working fluid in a counterflow heat transfer arrangement with the second air flow 128 directed across the second heat exchanger 108 (e.g., via the second fan 144) in the second direction 138. From the outlet port 152 of the second heat exchanger 108, the vapor compression circuit 102 may direct the working fluid to the valve 300. Specifically, the valve 300 may receive a flow (e.g., third flow) of working fluid from the second heat exchanger 108 via the fifth port 316. In the second configuration 350, the valve 300 may direct the flow of working fluid from the fifth port 316, through the second chamber 324, and out of the second chamber 324 via the fourth port 314 to direct the flow of working fluid toward the suction port 202 of the compressor 104.

Accordingly, in the second configuration 350, the valve 300 is configured to direct the working fluid through the vapor compression circuit 102 to enable the heating mode of the heat pump 100 (e.g., to heat the first air flow 126, supply air flow) and to also place the working fluid in a counterflow arrangement with the first air flow 126 directed across the first heat exchanger 106 and in a counterflow arrangement with the second air flow 128 (e.g., ambient air flow) directed across the second heat exchanger 108. By establishing a counterflow heat exchange relationship between the working fluid circulated through the first and second heat exchangers 106, 108 and the corresponding air flows 126, 128 in the heating mode of the heat pump 100, the valve 300 enables improved efficiency of the heat pump 100 (e.g., increased heat transfer efficiency, increased energy efficiency, reduced energy consumption). Indeed, the vapor compression circuit 102 having the valve 300 is configured to operate with reduced greenhouse gas emissions by operating to heat and cool an air flow in an energy efficient manner and without operation of a furnace or other system that consumes a fuel.

It should be appreciated that the valve system 116 having the valve 300 may be incorporated in any suitable embodiment of the heat pump 100 (e.g., heat pump) to enable counterflow heat exchange relationships between the working fluid circulated through the first and second heat exchangers 106, 108 and the corresponding air flows 126, 128 in both the heating mode and the cooling mode. For example, the valve 300 may be incorporated in a split system heat pump, such as an embodiment of the residential heating and cooling system 50 having the indoor unit 56 and the outdoor unit 58. The valve 300 may be desirable for incorporation with the outdoor unit 58 having the compressor 104 and the second heat exchanger 108. In particular, two working fluid conduits 54 may be fluidly coupled to the third port 312 and the fourth port 314 of the valve 300 and may extend from the outdoor unit 58 to the indoor unit 56 to fluidly couple to the first heat exchanger 106 (e.g., to the inlet port 140 and the outlet port 142) disposed within the indoor unit 56.

Figure 9:
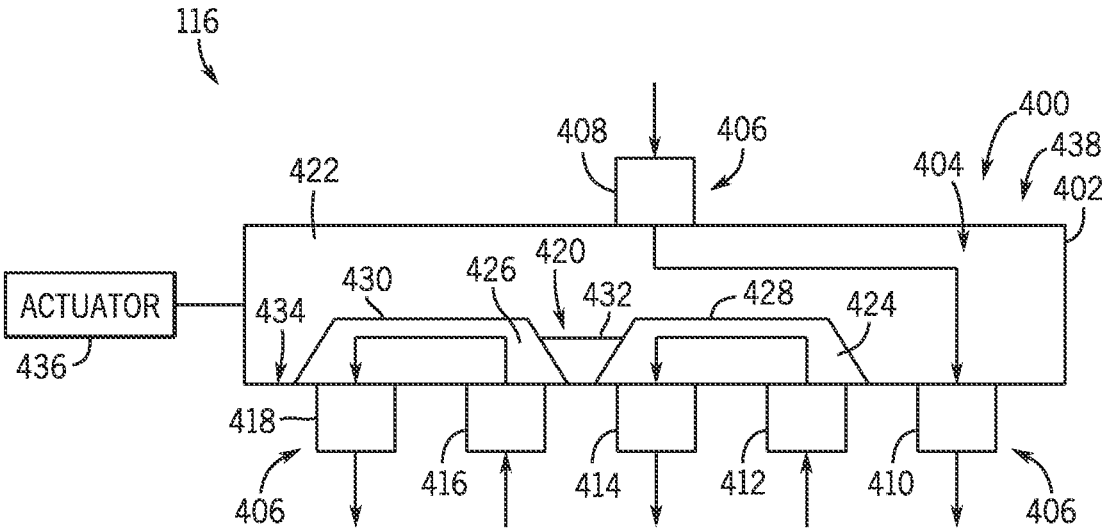
FIG. 9 is a schematic of an embodiment of a valve system for a heat pump, illustrating a cooling mode configuration of the valve system, in accordance with an aspect of the present disclosure.

FIG. 9 is schematic of an embodiment of the valve system 116 including a valve 400 (e.g., a hexa-valve, a six-way valve, switching valve, a single valve) configured to be disposed along the vapor compression circuit 102. The valve 400 is configured to adjust a flow direction and/or a flow path of working fluid through the vapor compression circuit 102 to enable adjustment of an operating mode of the heat pump 100 and to enable counterflow heat transfer arrangements between the working fluid and multiple air flows. In some embodiments, the valve 400 may be incorporated with the vapor compression circuit 102 instead of the valve 300 discussed above and may enable the functionality described herein.

The valve 400 includes a housing 402 defining an internal volume 404 configured to receive and direct flows of working fluid therethrough. Similar to the valve 300, the valve 400 also includes a plurality of ports 406 (e.g., openings, inlets, outlets) configured to direct working fluid into the internal volume 404 and/or to discharge working fluid from the internal volume 404 (e.g., based on a configuration of the valve 400). In particular, the valve 400 includes a first port 408, a second port 410, a third port 412, a fourth port 414, a fifth port 416, and a sixth port 418. The first port 408, the second port 410, the third port 412, the fourth port 414, the fifth port 416, and the sixth port 418 may be fluidly coupled to the vapor compression circuit 102 in a similar manner or configuration as the first port 308, the second port 310, the third port 312, the fourth port 314, the fifth port 316, and the sixth port 318, respectively, of the valve 300 described above. In this way, the valve 400 may provide similar functionality as the valve 300, as further described below.

The valve 400 also includes a slide body 420 (e.g., slider, slide assembly, flow divider, etc.) disposed within the housing 402 and configured to separate the internal volume 404 into a plurality of chambers (e.g., a first chamber 422, a second chamber 424, and a third chamber 426). The slide body 420 includes a first divider portion 428 configured to define the second chamber 424 and fluidly separate the second chamber 424 from the first chamber 422. The slide body 420 also includes a second divider portion 430 configured to define the third chamber 426 and fluidly separate the third chamber 426 from the first chamber 422. The first divider portion 428 and the second divider portion 430 are coupled (e.g., attached, secured) to one another, such as via a link or connector 432. As will be appreciated, the first divider portion 428 and the second divider portion 430 may abut against an internal surface 434 of the housing 402 to enable fluid separation of the first chamber 422, the second chamber 424, and the third chamber 426 from one another.

The first divider portion 428 and the second divider portion 430 are configured to fluidly couple at least two of the ports 406 and to fluidly separate the at least two ports 406 from remaining ports 406 of the valve 400 (e.g., via sealing engagement between the slide body 420 and the internal surface 434 of the housing 402). In this way, the slide body 420 enables receipt and discharge of multiple flows of the working fluid through the valve 400. A position of the slide body 420 within the housing 402 is adjustable to enable fluid coupling of different ports 406 with one another (e.g., based on an operating mode of the heat pump 100). In this way, flow of the working fluid through the vapor compression circuit 102 may be adjusted (e.g., to transition operation of the heat pump 100 between the heating mode and the cooling mode), as similarly described above. The position of the slide body 420 may be adjusted by an actuator 436. The actuator 436 may be an electromechanical actuator, a magnetic actuator, a linear actuator, a hydraulic actuator, a pneumatic actuator, a pilot valve, another suitable actuator, or any combination thereof. The actuator 436 may also be communicatively coupled to the controller 174. The controller 174 may be configured to adjust the position of the slide body 420 within the housing 402 to enable operation of the heat pump 100 in different operating modes (e.g., heating mode, cooling mode), such as based on a signal, instruction, or data received from the control device 16 (e.g., thermostat).

In the illustrated embodiment, the valve 400 is positioned in a first configuration 438 (e.g., the slide body 420 is in a first position within the housing 402) to enable operation of the heat pump 100 in the cooling mode. In the first configuration 438, the first divider portion 428 of the slide body 420 fluidly couples the third port 412 and the fourth port 414 via the second chamber 424 and fluidly isolates the third port 412 and the fourth port 414 from the first port 408, the second port 410, the fifth port 416, and the sixth port 418. Similarly, the second divider portion 430 fluidly couples the fifth port 416 and the sixth port 418 via the third chamber 426 and fluidly isolates the fifth port 416 and the sixth port 418 from the first port 408, the second port 410, the third port 412, and the fourth port 414. Thus, the first port 408 and the second port 410 may be fluidly coupled via the first chamber 422.

As mentioned above, the valve 400 in the first configuration 438 enables operation of the heat pump 100 in the cooling mode. For example, in the first configuration 438, the valve 400 is configured to receive a flow of working fluid (e.g., a first flow) from the discharge port 200 of the compressor 104 via the first port 408. The valve 400 may direct the flow of working fluid from the first port 408, through the first chamber 422, and out of the first chamber 422 via the second port 410 to direct the flow of working fluid toward the second heat exchanger 108 (e.g., operating as a condenser) to place the working fluid in a counterflow heat transfer arrangement with the second air flow 128 in the manner described above. The valve 400 may also receive a flow (e.g., second flow) of working fluid from the second heat exchanger 108 via the fifth port 416. In the first configuration 438, the valve 400 (e.g., the second divider portion 430) may direct the flow of working fluid from the fifth port 416, through the third chamber 426, and out of the third chamber 426 via the sixth port 418 to direct the flow of working fluid toward the first expansion valve 112 and the first heat exchanger 106 (e.g., operating as an evaporator) to place the working fluid in a counterflow heat transfer arrangement with the first air flow 126 in the manner described above. The valve 400 may further receive a flow (e.g., third flow) of working fluid from the first heat exchanger 106 via the third port 412. In the first configuration 438, the valve 400 (e.g., the first divider portion 428) may direct the flow of working fluid from the third port 412, through the second chamber 424, and out of the second chamber 424 via the fourth port 414 to direct the flow of working fluid toward the suction port 202 of the compressor 104.

Figure 10:
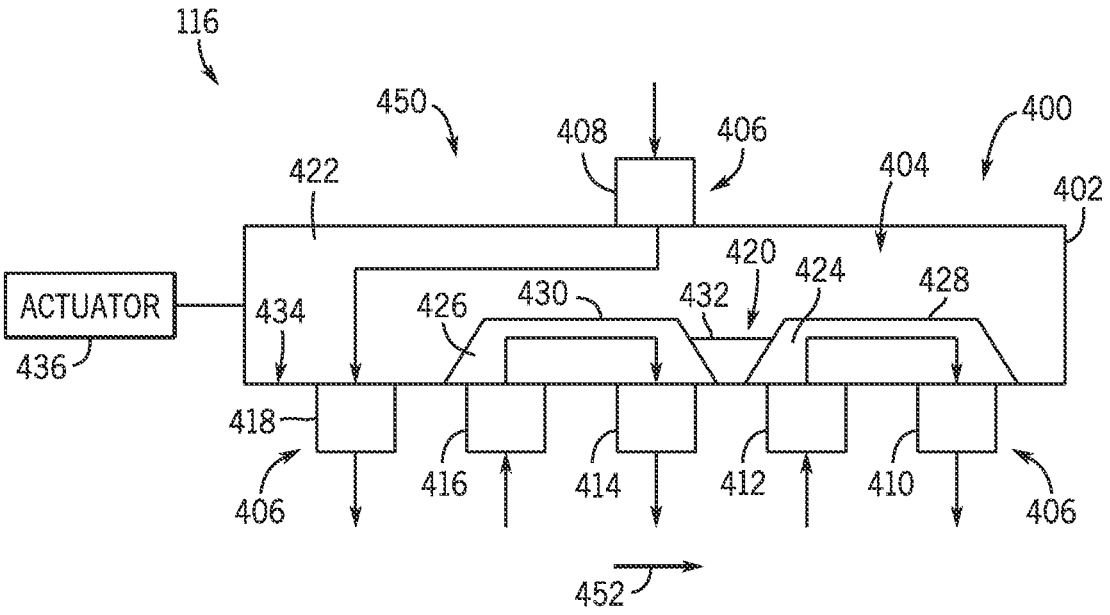
FIG. 10 is a schematic of an embodiment of a valve system for a heat pump, illustrating a heating mode configuration of the valve system, in accordance with an aspect of the present disclosure.

FIG. 10 is a schematic of an embodiment of the valve system 116 including the valve 400 (e.g., a hexa-valve, a six-way valve, switching valve, a single valve) positioned in a second configuration 450 (e.g., the slide body 420 is in a second position within the housing 402) to enable operation of the heat pump 100 in the heating mode. As mentioned above, the actuator 436 may adjust a position of the slide body 420 within the housing 402 (e.g., by linearly translating the slide body 420 in a direction 452) to enable transition of the slide body 420 between the first configuration 438 and the second configuration 450. As similarly discussed above, the controller 174 may control the actuator 436 to transition the valve 400 (e.g., the slide body 420) to the second configuration 450 in response to receipt of a call for heating (e.g., from the control device 16).

In the second configuration 450, the first divider portion 428 of the slide body 420 fluidly couples the second port 410 and the third port 412 via the second chamber 424 and fluidly isolates the second port 410 and the third port 412 from the first port 408, the fourth port 414, the fifth port 416, and the sixth port 418. Similarly, the second divider portion 430 fluidly couples the fourth port 414 and the fifth port 416 via the third chamber 426 and fluidly isolates the fourth port 414 and the fifth port 416 from the first port 408, the second port 410, the third port 412, and the sixth port 418. Thus, the first port 408 and the sixth port 418 are fluidly coupled via the first chamber 422.

As mentioned above, the valve 400 in the second configuration 450 enables operation of the heat pump 100 in the heating mode. For example, in the second configuration 450, the valve 400 is configured to receive a flow of working fluid (e.g., a first flow) from the discharge port 200 of the compressor 104 via the first port 408. The valve 400 may direct the flow of working fluid from the first port 408, through the first chamber 422, and out of the first chamber 422 via the sixth port 418 to direct the flow of working fluid toward the first heat exchanger 106 (e.g., operating as a condenser) to place the working fluid in a counterflow heat transfer arrangement with the first air flow 126 in the manner described above. The valve 400 may also receive a flow (e.g., second flow) of working fluid from the first heat exchanger 106 via the third port 412. In the second configuration 450, the valve 400 (e.g., the first divider portion 428) may direct the flow of working fluid from the third port 412, through the second chamber 424, and out of the second chamber 424 via the second port 410 to direct the flow of working fluid toward the second expansion valve 114 and the second heat exchanger 108 (e.g., operating as an evaporator, toward the inlet port 150) to place the working fluid in a counterflow heat transfer arrangement with the second air flow 128 in the manner described above. The valve 400 may further receive a flow (e.g., third flow) of working fluid from the second heat exchanger 108 (e.g., from the outlet port 152) via the fifth port 416. In the second configuration 450, the valve 400 (e.g., the second divider portion 430) may direct the flow of working fluid from the fifth port 516, through the third chamber 426, and out of the third chamber 426 via the third port 412 to direct the flow of working fluid toward the suction port 202 of the compressor 104.

As discussed in detail above, embodiments of the present disclosure include a valve system for a heat pump or other HVAC system that enables more efficient operation of the heat pump in a heating mode and in a cooling mode of the heat pump. Specifically, the valve system is configured to establish a counterflow arrangement between a working fluid and a first air flow via a first heat exchanger and to establish a counterflow arrangement between the working fluid and a second air flow in both the cooling mode of the heat pump and in the heating mode of the heat pump. In this way, present embodiments enable more efficient operation of the heat pump in both modes, as well as more efficient overall operation of the heat pump. That is, the heat pump (e.g., HVAC system) may operate in the cooling mode and in the heating mode with improved heat transfer efficiency, improved energy efficiency, and/or reduced energy consumption. Indeed, the heat pumps disclosed herein are configured to operate with reduced greenhouse gas emissions by operating to heat and cool an air flow in an energy efficient manner and without operation of a furnace or other system that consumes a fuel.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. An energy efficient heat pump for a heating, ventilation, and air conditioning (HVAC) system, comprising:

a vapor compression circuit;

a first heat exchanger of the vapor compression circuit configured to place a working fluid in a first heat exchange relationship with a first air flow directed across the first heat exchanger, wherein the heat pump is configured to discharge the first air flow toward a conditioned space;

a second heat exchanger of the vapor compression circuit configured to place the working fluid in a second heat exchange relationship with a second air flow directed across the second heat exchanger; and a valve system of the vapor compression circuit, wherein the valve system is adjustable between a first configuration and a second configuration, the heat pump is configured to operate in a cooling mode with the valve system in the first configuration, the heat pump is configured to operate in a heating mode with the valve system in the second configuration, and the valve system is configured to direct the working fluid into the first heat exchanger to place the working fluid in a counterflow heat transfer arrangement with the first air flow directed across the first heat exchanger in the first configuration and in the second configuration.

2. The energy efficient heat pump of claim 1, wherein the valve system is configured to direct the working fluid into the second heat exchanger to place the working fluid in an additional counterflow heat transfer arrangement with the second air flow directed across the second heat exchanger in the first configuration and in the second configuration.

3. The energy efficient heat pump of claim 1, wherein the valve system comprises a first valve, a second valve, and a third valve.

4. The energy efficient heat pump of claim 3, wherein the first valve is a first four-way valve, the second valve is a second four-way valve, and the third valve is a third four-way valve.

5. The energy efficient heat pump of claim 3, comprising a compressor of the vapor compression circuit, wherein, in the first configuration of the valve system:

the first valve is configured to direct the working fluid from the compressor to the third valve, the third valve is configured to direct the working fluid from the second heat exchanger to the second valve, and the second valve is configured to direct the working fluid from the first heat exchanger to the first valve.

6. The energy efficient heat pump of claim 5, wherein, in the second configuration of the valve system:

the first valve is configured to direct the working fluid from the compressor to the second valve, the second valve is configured to direct the working fluid from the first heat exchanger to the third valve, and the third valve is configured to direct the working fluid from the second heat exchanger to the first valve.

7. The energy efficient heat pump of claim 3, comprising a compressor of the vapor compression circuit, wherein the first valve is configured to receive the working fluid from the compressor and to direct the working fluid to the compressor in the first configuration and in the second configuration.

8. The energy efficient heat pump of claim 7, wherein the second valve is configured to direct the working fluid to a first inlet port of the first heat exchanger and to receive the working fluid from a first outlet port of the first heat exchanger in the first configuration and in the second configuration.

9. The energy efficient heat pump of claim 8, wherein the third valve is configured to direct the working fluid to a second inlet port of the second heat exchanger and to receive the working fluid from a second outlet port of the second heat exchanger in the first configuration and in the second configuration.

10. An energy efficient heat pump for a heating, ventilation, and air conditioning (HVAC) system, comprising:

a vapor compression circuit configured to circulate a working fluid therethrough;

a first heat exchanger disposed along the vapor compression circuit, wherein the first heat exchanger is configured to place the working fluid in a first heat exchange relationship with a first air flow directed across the first heat exchanger;

a second heat exchanger disposed along the vapor compression circuit, wherein the second heat exchanger is configured to place the working fluid in a second heat exchange relationship with a second air flow directed across the second heat exchanger; and a valve system disposed along the vapor compression circuit, wherein the valve system is configured to direct the working fluid to a first inlet port of the first heat exchanger and to receive the working fluid from a first outlet port of the first heat exchanger in a cooling mode of the heat pump and in a heating mode of the heat pump, and the valve system is configured to direct the working fluid to a second inlet port of the second heat exchanger and to receive the working fluid from a second outlet port of the second heat exchanger in the cooling mode and in the heating mode.

11. The energy efficient heat pump of claim 10, wherein the first heat exchanger is configured to direct the working fluid from the first inlet port to the first outlet port in a first counterflow heat transfer arrangement with the first air flow in the cooling mode and in the heating mode, and the second heat exchanger is configured to direct the working fluid from the second inlet port to the second outlet port in a second counterflow heat transfer arrangement with the second air flow in the cooling mode and in the heating mode.

12. The energy efficient heat pump of claim 10, wherein the valve system comprises a first four-way valve, a second four-way valve, and a third four-way valve.

13. The energy efficient heat pump of claim 12, comprising a compressor disposed along the vapor compression circuit, wherein:

the first four-way valve is configured to receive the working fluid from the compressor and to direct the working fluid to the compressor in the cooling mode and in the heating mode, the second four-way valve is configured to direct the working fluid to the first inlet port of the first heat exchanger and to receive the working fluid from the first outlet port of the first heat exchanger in the cooling mode and in the heating mode, and the third four-way valve is configured to direct the working fluid to the second inlet port of the second heat exchanger and to receive the working fluid from the second outlet port of the second heat exchanger in the cooling mode and in the heating mode.

14. The energy efficient heat pump of claim 12, wherein the first four-way valve, the second four-way valve, and the third four-way valve are each configured to direct the working fluid to one another and are each configured to receive the working fluid from one another.

15. The energy efficient heat pump of claim 12, wherein the first four-way valve, the second four-way valve, and the third four-way valve are each configured to be positioned in a respective first position in the cooling mode and are each configured to be positioned in a respective second position in the heating mode.

16. An energy efficient heat pump for a heating, ventilation, and air conditioning (HVAC) system, comprising:

a compressor;

a first heat exchanger comprising a first inlet port and a first outlet port, wherein the first heat exchanger is configured to direct a working fluid from the first inlet port to the first outlet port to place the working fluid in a first counterflow arrangement with a first air flow directed across the first heat exchanger;

a second heat exchanger comprising a second inlet port and a second outlet port, wherein the second heat exchanger is configured to direct the working fluid from the second inlet port to the second outlet port to place the working fluid in a second counterflow arrangement with a second air flow directed across the second heat exchanger; and a valve system configured to control flow of the working fluid through the heat pump, wherein the valve system is configured to direct the working fluid to the first inlet port and to the second inlet port in a cooling mode of the heat pump and in a heating mode of the heat pump, and wherein the valve system is configured to receive the working fluid from the first outlet port and from the second outlet port in the cooling mode and in the heating mode.

17. The energy efficient heat pump of claim 16, wherein the valve system comprises a plurality of valves comprising a first four-way valve, a second four-way valve, and a third four-way valve, wherein the plurality of valves is fluidly coupled to one another, the plurality of valves is configured to direct the working fluid to one another and to receive the working fluid from one another.

18. The energy efficient heat pump of claim 1, wherein the valve system comprises a first four-way valve and a second four-way valve, and wherein the first four-way valve is configured to direct the working fluid to a first inlet port of the first heat exchanger and to receive the working fluid from a first outlet port of the first heat exchanger in the cooling mode and in the heating mode.

19. The energy efficient heat pump of claim 18, wherein the second four-way valve is configured to direct the working fluid to a second inlet port of the second heat exchanger and to receive the working fluid from a second outlet port of the second heat exchanger in the cooling mode and in the heating mode.

20. The energy efficient heat pump of claim 16, wherein the valve system comprises a first four-way valve and a second four-way valve, wherein the first four-way valve is configured to direct the working fluid to the first inlet port of the first heat exchanger and to receive the working fluid from the first outlet port of the first heat exchanger in the cooling mode and in the heating mode, and the second four-way valve is configured to direct the working fluid to the second inlet port of the second heat exchanger and to receive the working fluid from the second outlet port of the second heat exchanger in the cooling mode and in the heating mode.

* * * * *